US008820734B2

(12) United States Patent
Miyakawa et al.

(10) Patent No.: US 8,820,734 B2
(45) Date of Patent: Sep. 2, 2014

(54) LOADING DEVICE FOR RECORDING MEDIA, CONTROL METHOD THEREOF, AND RECORDING MEDIUM

(71) Applicants: Takahiro Miyakawa, Kanagawa (JP); Koichi Suse, Kanagawa (JP); Shingo Hayashi, Kanagawa (JP); Osamu Kizaki, Saitama (JP)

(72) Inventors: Takahiro Miyakawa, Kanagawa (JP); Koichi Suse, Kanagawa (JP); Shingo Hayashi, Kanagawa (JP); Osamu Kizaki, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/920,118

(22) Filed: Jun. 18, 2013

(65) Prior Publication Data

US 2013/0341854 A1 Dec. 26, 2013

(30) Foreign Application Priority Data

Jun. 25, 2012 (JP) ..... 2012-142412

(51) Int. Cl.
*B65H 1/00* (2006.01)

(52) U.S. Cl.
USPC ..... 271/171; 271/161; 271/221

(58) Field of Classification Search
CPC ..... B65H 1/04; B65H 2511/10; B65H 1/266; B65H 2511/12
USPC ..... 271/161, 171, 221
See application file for complete search history.

(56) References Cited

U.S. PATENT DOCUMENTS

| | | | |
|---|---|---|---|
| 5,434,650 | A | 7/1995 | Nakahara et al. |
| 5,485,246 | A | 1/1996 | Hayashi et al. |
| 5,510,876 | A | 4/1996 | Hayashi et al. |
| 5,546,164 | A | 8/1996 | Hayashi et al. |
| 5,583,615 | A | 12/1996 | Hashimoto et al. |
| 5,694,201 | A | 12/1997 | Hayashi et al. |
| 5,784,663 | A | 7/1998 | Hayashi et al. |
| 5,812,900 | A | 9/1998 | Hashimoto et al. |
| 5,897,236 | A | 4/1999 | Hashimoto et al. |
| 5,915,156 | A | 6/1999 | Kizaki et al. |
| 5,966,564 | A | 10/1999 | Kizaki et al. |
| 6,026,255 | A | 2/2000 | Kizaki et al. |
| 6,122,457 | A | 9/2000 | Kizaki |
| 7,307,750 | B2 | 12/2007 | Kizaki |

(Continued)

FOREIGN PATENT DOCUMENTS

| | | |
|---|---|---|
| JP | 01-104524 | 4/1989 |
| JP | 05-069951 | 3/1993 |

(Continued)

*Primary Examiner* — Prasad Gokhale
(74) *Attorney, Agent, or Firm* — Harness, Dickey & Pierce, P.L.C.

(57) ABSTRACT

A loading device includes a disposing unit to dispose the recording media, and a detector to detect the disposed recording media. The disposing unit includes a loading member on which the recording media are loaded, a pair of guide members movable in width directions of the recording media that are mounted on the loading member, and a guide driver to move the guide members. The end detector detects positions at which the guide members are in contact with the recording media as the ends of the recording media. The guide driver further moves the guide members in the width direction to cause the recording media to form flexures, subsequently moves the guide members to separate from the recording media, and then moves the guide members to be in contact with the recording media again.

8 Claims, 14 Drawing Sheets

(56) References Cited

U.S. PATENT DOCUMENTS

| | | | | |
|---|---|---|---|---|
| 7,369,256 | B2 | 5/2008 | Kizaki | |
| 7,515,293 | B2 | 4/2009 | Kizaki et al. | |
| 7,595,903 | B2 | 9/2009 | Kizaki et al. | |
| 7,635,123 | B2 | 12/2009 | Watanabe et al. | |
| 7,782,473 | B2 | 8/2010 | Kizaki et al. | |
| 7,904,831 | B2 | 3/2011 | Kizaki | |
| 7,941,082 | B2 | 5/2011 | Kosako et al. | |
| 8,311,464 | B2 | 11/2012 | Kawase et al. | |
| 8,331,836 | B2 | 12/2012 | Kamekura et al. | |
| 8,335,446 | B2 | 12/2012 | Kobayashi et al. | |
| 8,345,077 | B2 | 1/2013 | Hayashi | |
| 8,364,063 | B2 | 1/2013 | Ishii et al. | |
| 8,369,756 | B2 | 2/2013 | Kosako et al. | |
| 8,387,974 | B2 * | 3/2013 | Hayashi | 271/213 |
| 8,437,671 | B2 | 5/2013 | Miyakawa et al. | |
| 2003/0035142 | A1 | 2/2003 | Kizaki | |
| 2003/0151188 | A1 * | 8/2003 | Imahara | 271/171 |
| 2004/0109186 | A1 | 6/2004 | Shindoh et al. | |
| 2004/0114171 | A1 | 6/2004 | Shindoh et al. | |
| 2004/0136022 | A1 | 7/2004 | Kizaki et al. | |
| 2004/0233466 | A1 | 11/2004 | Shindoh et al. | |
| 2006/0075362 | A1 | 4/2006 | Moteki et al. | |
| 2010/0302569 | A1 | 12/2010 | Enami et al. | |
| 2011/0229219 | A1 | 9/2011 | Kobayashi et al. | |
| 2013/0250328 | A1 * | 9/2013 | Ohtsuka et al. | 358/1.13 |

FOREIGN PATENT DOCUMENTS

| | | |
|---|---|---|
| JP | 08-113379 | 5/1996 |
| JP | 11-314768 | 11/1999 |
| JP | 2000-169020 | 6/2000 |
| JP | 2001-171893 | 6/2001 |
| JP | 2002-029656 | 1/2002 |
| JP | 2006-056681 | 3/2006 |
| JP | 2007-076808 | 3/2007 |

* cited by examiner

LOADING DEVICE FOR RECORDING MEDIA, CONTROL METHOD THEREOF, AND RECORDING MEDIUM

BACKGROUND OF THE INVENTION

1. Field of the Invention

The embodiments discussed herein relate to a loading device for loading recording media and a control method of the loading device.

2. Description of the Related Art

A certain type of a loading device for loading recording media includes guide members capable of changing their positions based on the size of recording media loaded.

For example, Japanese Laid-open Patent Publication No. 2000-169020 (hereinafter called "Patent Document 1") discloses a technology that pertains to a paper-feed tray (i.e., the loading device for loading recording media) capable of adjusting an interval between side fences based on the size of sheets of paper utilizing a pair of the side fences that move in directions in which the side fences move toward the loaded sheets or is separated from the loaded sheets (i.e., the recording media).

An image forming apparatus or the like may generally be provided with a manual loading device (e.g., a manual bypass unit) for a user to manually feed/insert sheets of paper. However, when the user manually feeds the sheets into the manual bypass unit, the sheets are not necessarily set (disposed) at accurate and correct positions.

In the technology disclosed in Patent Document 1, the size of the sheets is initially detected and the interval between the side fences is adjusted after the detection of the size of the sheets. Hence, when ends of the sheets are not aligned or parts of the sheets are creased, the sheets are not necessarily set at accurate and correct positions.

RELATED ART DOCUMENTS

Patent Document

Patent Document 1: Japanese Laid-open Patent Publication No. 2000-169020

SUMMARY OF THE INVENTION

Accordingly, it is a general object in one embodiment of the present invention to provide a novel and useful loading device for loading recording media capable of aligning ends of loaded recording media by causing the recording media to form flexures.

According to one aspect of the embodiment, there is provided a loading device for loading a plurality of recording media that includes a disposing unit configured to dispose the recording media; and a detector configured to detect the disposed recording media. The disposing unit includes a loading member on which the recording media are loaded, a pair of guide members mounted on the loading member and configured to be movable in width directions of the recording media, and a guide driver configured to move the guide members. The detector includes a medium detector configured to detect the recording media that have been loaded in an interval between the pair of the guide members, and an end detector configured to detect ends of the loaded recording media. The end detector detects respective positions at which the guide members moved by the guide driver are in contact with the recording media as the ends of the recording media after the medium detector has detected the recording media. The guide driver further moves, after having moved the guide members in the width direction to cause the guide members to be in contact with the recording media, the guide members in the width direction to cause the recording media to form flexures, subsequently moves the guide members to separate from the recording media, and then moves the guide members to be in contact with the recording media again.

The object and advantages of the invention will be realized and attained by means of the elements and combinations particularly pointed out in the claims.

It is to be understood that both the foregoing general description and the following detailed description are exemplary and explanatory and are not restrictive of the invention as claimed.

Other objects and further features of the present invention will be apparent from the following detailed description when read in conjunction with the accompanying drawings.

DESCRIPTION OF THE PREFERRED EMBODIMENTS

A description will be given of embodiments of the present invention, by referring to the accompanying drawings.

More specifically, a description will be given of embodiments of a loading device for recording media that is applied to a manual loading device to which a user manually feeds sheets of paper (hereinafter called a "manual bypass unit") installed in an image forming apparatus.

The embodiments may be applied to any loading devices other than the loading device for recording media illustrated below insofar as the loading devices load, dispose, or stack recording media in apparatuses such as a copier, a recording apparatus, a printer, a scanner, and a facsimile machine. Further, the embodiments may be applied to any devices that supply, feed, or introduce recording media in apparatuses such as an image forming apparatus. In addition, the embodiments may be applied to any devices that save, maintain or collect recording media, or export or discharge the recording media in apparatuses such as an image forming apparatus.

Note that examples of recording media capable of being loaded on the loading device according to the embodiments may include standard paper, high-quality paper, thin paper, thick paper, recording paper, recycled paper, coated paper, an overhead projector (OHP) sheet, a plastic film, and other sheet media.

Configuration of Loading Device

A loading device for recording media according to the embodiments may be capable of disposing loaded recording media at a desired position utilizing a disposing unit. In addition, the loading device for recording media according to the embodiments may be capable of detecting loaded recording media utilizing a detector. Further, the loading device for recording media according to the embodiments may be capable of judging whether respective ends of a plurality of the loaded recording media are aligned (in an aligned state) utilizing a judging unit.

A configuration of a loading device 100 for recording media (hereinafter also called a "recording media loading device" or simply called a "loading device") according to an embodiment is described with reference to FIG. 1.

Figure 1:
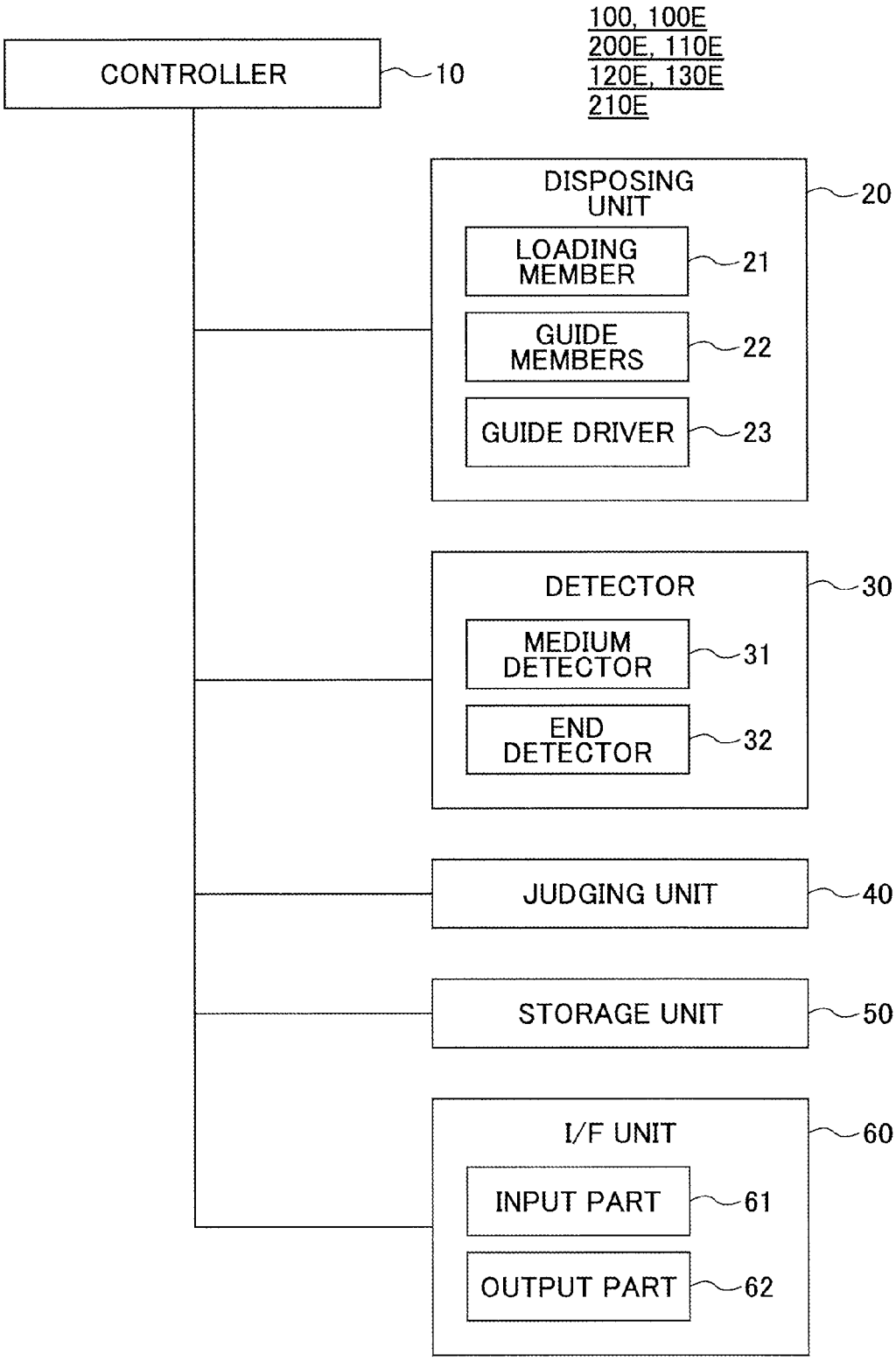
FIG. 1 is a schematic configuration diagram illustrating an example of a loading device for recording media according to an embodiment.

As illustrated in FIG. 1, the loading device for recording media (hereinafter also called a "loading device") 100 according to the embodiment includes a controller 10 configured to control operations of the loading device 100, a disposing unit 20 configured to dispose loaded recording media on the loading device 100 at a desired position, and a detector 30 configured to detect the recording media loaded (disposed) on the loading device 100. The loading device 100 according to the embodiment further includes a judging unit 40 configured to judge a loaded state of the recording media loaded on the loading device 100. The loading device 100 according to the embodiment further includes a storage unit 50 configured to store a program associated with the control of the loading device 100, a detected result detected by the detector 30, and a judged result judged by the judging unit 40, and an interface (I/F) unit 60 configured to handle input/output of information to devices external to the loading device 100.

The control unit 10 is configured to send operational instructions to elements of the loading device 100 so as to control operations of the respective elements. The control unit 10 may alternatively control operations of the elements such as the disposing unit 20 utilizing programs (a control program, applications, etc.) stored in advance in, for example, the storage unit 50. Further, the control unit 10 may control operations of the elements such as the disposing unit 20 based on information input via the I/F unit 60 (an input part 61 or the like). Moreover, the control unit 10 may control operations of the elements such as the I/F unit 60 (an output part 62 or the like) so as to output information associated with the loading device 100.

The control unit 10 according to the embodiment may be capable of controlling operations of the disposing unit 20 to dispose recording media. Further, the control unit 10 according to the embodiment may be capable of controlling operations of the detector to detect the loaded (disposed) recording media. Moreover, the control unit 10 according to the embodiment may be capable of controlling operations of the judging unit 40 to judge a loaded state of the recording media.

Note that the control unit 10 may be configured to include a not-illustrated storage part to store information and the like. The control unit 10 may be configured to (temporarily) store programs and an operational condition necessary for operating the loading device 100 in the not-illustrated storage part.

The disposing unit 20 is configured to dispose loaded recording media at a desired position. The disposing unit 20 according to the embodiment includes a loading member 21 on which the recording media are loaded, a pair of guide members 22 mounted on the loading member 21, and a guide driver 23 configured to move the guide members 22.

The disposing unit 20 according to the embodiment may be capable of loading the recording media on the loading member 21. Further, the disposing unit 20 according to the embodiment may be capable of loading the recording media in an interval between the pair of the guide members 22 mounted on the loading member 21. In addition, the disposing unit 20 according to the embodiment may be capable of moving (disposing) the recording media loaded in the interval between the pair of the guide members 22 at a desired position by utilizing (driving) the guide driver 23 to move the guide members 22.

Note that the desired position indicates a position at which the recording media are disposed in order for the loading device 100 to be capable of maintaining (storing, and loading) the recording media. In addition, the desired position also indicates a position determined based on respective specifications of the loading device 100 and the recording media. Moreover, the desired position may be a predetermined position obtained based on experiments, numeric computation, or the like.

The loading member 21 is configured to receive the recording media loaded by a user (a device user, a device operator, a device administrator, etc., hereinafter simply called a "user"). In this embodiment, the recording media are loaded on the loading member 21 by the user's hands (e.g., the recording media are manually fed by the user's hands).

The guide members 22 are configured to move (guide) the recording media loaded on the loading member 21. The loading device 100 (the disposing unit 20) according to the embodiment includes the pair of the guide members 22 (e.g., indicated by reference numerals 22*a* and 22*b* in FIG. 3A).

The pair of the guide members 22 is mounted on the loading member 21, and the recording media are loaded in the interval between the pair of the guide members 22. The interval between the pair of the guide members 22 may be changed by the later-described guide driver 23. That is, the pair of the guide members 22 may be moved by the guide driver 23 in directions close to the loaded recording media (i.e., the guide members move toward the recording media) or away from the loaded recording media (i.e., the guide members are separated from the recording media).

The guide driver 23 is configured to move the guide members 22. The guide driver 23 may, for example, move the guide members 22 utilizing a rotary drive of a motor or the like.

In this embodiment, the guide driver 23 is configured to drive the guide members 22 in a direction orthogonal to a direction in which the recording media loaded on the disposing unit 20 are to be transferred to an image forming part of an image forming apparatus (hereinafter called a "width direction of recording media"). Thus, the guide driver 23 may be able to move the recording media utilizing the pair of the guide members 22.

Note that the guide driver 23 may move both (i.e., first and second guide members) of the pair of the guide members 22. Note also that the guide driver 23 may move one (i.e., the first or the second guide member) of the pair of the guide members 22.

The detector 30 is configured to detect the recording media loaded on the disposing unit 20 (the loading member 21). The detector 30 according to the embodiment includes a medium detector 31 configured to detect the loaded recording media, and an end detector 32 configured to detect ends of the loaded (disposed) recording media.

The detector 30 according to the embodiment may be able to detect the recording media loaded on the loading member 21 utilizing the medium detector 31. In addition, the detector 30 according to the embodiment may be able to detect the ends of the recording media loaded (disposed) on the loading member 21 utilizing the end detector 32.

The medium detector 31 is configured to detect the loaded recording media. In this embodiment, the medium detector 31 is configured to detect whether the recording media are loaded in the interval between the pair of the guide members 22. The medium detector 31 may, for example, employ various kinds of detectors including pressure-sensitive, electrostatic, and photosensitive (photoelectric) detectors.

The end detector 32 is configured to detect the ends of the recording media. In this embodiment, the end detector 32 is configured to detect, as the ends of the recording media, positions at which the guide members of the disposing unit 20 are in contact with the recording media. That is, the end detector 32 may be able to detect the positions of the ends of the recording media by detecting the guide members 22 moved by the guide driver 23 being in contact with the recording media.

Note that respective detecting methods of the medium detector 31 and the end detector 32 are not limited to the above-described methods. That is, the detector 30 according to the embodiment may detect the recording media utilizing any other technologies known in the art.

The judging unit 40 is configured to judge a loaded state of the recording media loaded on the disposing unit 20. Note that the loaded state in this embodiment indicates that ends of the recording media are either aligned or not aligned when a plurality of recording media are loaded on the loading member 21.

The judging unit 40 according to the embodiment may be able to judge the loaded state based on a detected result obtained by the detector 30. That is, the judging unit 40 according to the embodiment may be able to judge whether the ends of the plurality of the loaded (disposed) recording media are aligned based on the detected result obtained by the detector 30.

Specifically, the judging unit 40 may be able to judge the ends of the plurality of the recording media as being in an aligned state when the difference between a first end position initially detected by the end detector 32 and a second end position subsequently detected by the end detector 32 is within a predetermined threshold. Note that the first end position is detected by the end detector 32 when the guide members 22 of the disposing unit 20 are initially moved, and the second end position is detected by the end detector 32 when the guide members 22 of the disposing unit 20 are subsequently moved. Further, the judging unit 40 may be able to judge the ends of the plurality of the recording media as being in a non-aligned state when the difference between the first position and the second position exceeds the predetermined threshold. Further, the judging unit 40 may be able to judge whether the ends of the plurality of the recording media are in the aligned state based on information associated with the recording media stored in the storage unit 50 and/or information input via the I/F unit 60.

Note that the predetermined threshold may be defined as a value based on which the loading device 100 (or image forming apparatus) is able to judge the ends of the plurality of the recording media as being in the aligned state. In addition, the predetermined position may be defined as a value corresponding to respective specifications of the loading device 100 and the recording media, and an operational condition of the loading device 100 (i.e., a driving condition of the guide members). Further, the predetermined threshold may be defined as a value predetermined based on experiments, numeric computation, or the like.

The storage unit 50 is configured to store information associated with the loading device 100 (e.g., information associated with a state of the loading device 100 or information associated with processing by the loading device 100), and information associated with the recording media (hereinafter referred to as "media information"). The storage unit 50 may, for example, be able to store the detected result obtained by the detector 30 or the judged result obtained by the judging unit 40. Note that the storage unit 50 may employ technologies (e.g., a hard disk drive, read-only memory (ROM), electrically erasable programmable read-only memory (EEPROM), and random-access memory (RAM)) known in the art.

The I/F unit 60 is configured to handle input/output of information (e.g., electric signals) between the loading device 100 and devices external to the loading device 100. The I/F unit 60 according to the embodiment may be able to input the information associated with the loading device 100 from an external device (e.g., a personal computer (PC)). In addition, the I/F unit 60 according to the embodiment may be able to output information associated with the loading device 100 to an external device (e.g., a personal computer (PC)).

The I/F unit 60 includes an input part 61 via which the user may input predetermined information (e.g., a loading condition, an operating condition, an output condition, etc.) from a device external to the loading device 100. The I/F unit 60 further includes an output part 62 configured to output (e.g., display) information to a device external to the loading device 100.

The input part 61 may be able to input information associated with processing. In this embodiment, the input part 61 may be able to input information (hereinafter referred to as "media information") associated with the recording media, such as the number of recording media, the thickness of the media, and the material of the recording media.

The output part 62 may be able to output information associated with states. The output part 62 may, for example, be able to output information associated with the detected result obtained by the detector 30 or the judged result obtained by the judging unit 40.

Functionality of Loading Device

Figure 2:
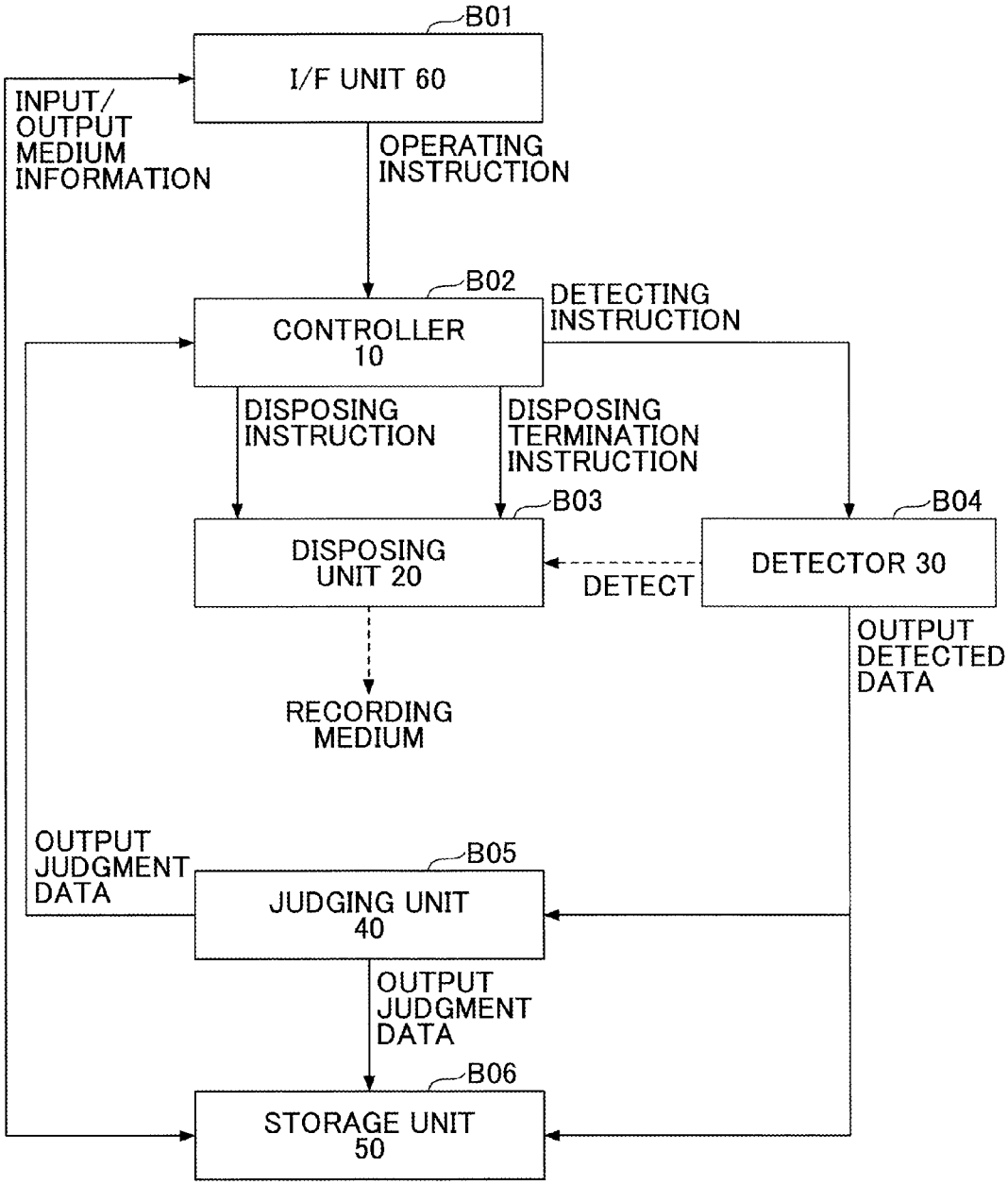
FIG. 2 is a functional block diagram illustrating an example of a function of the loading device for recording media according to the embodiment.

FIG. 2 illustrates an example of a functional block diagram of the loading device according to the embodiment.

As illustrated in FIG. 2, the loading device 100 (FIG. 1) outputs to the controller 10 information associated with operations of the loading device 100 (hereinafter referred to as an "operating instruction") acquired (input) via the I/F unit 60 (see B01 in FIG. 2). Note that the loading device 100 according to the embodiment may output the operating instruction based on information associated with an image forming instruction (e.g., print request, print job, etc.) when the loading device 100 is implemented in an image forming apparatus or the like.

The controller 10 is configured to control operations of the loading device 100 based on the input operating instruction (B02). Specifically, the controller 10 is configured to output a disposing instruction to the disposing unit 20 when the operating instruction is associated with an operation to dispose the recording media. In addition, the controller 10 is configured to output a disposing termination instruction to the disposing unit 20 when the operating instruction is associated with an operation to terminate (stop) the disposing of the recording media. Further, the controller 10 is configured to output a detecting instruction to the detector 30 when the operating instruction is associated with an operation to detect the recording media. Note that the controller 10 or the I/F unit 60 may output the operating instruction or the like into the storage unit 50.

Further, the controller 10 is configured to output the disposing termination instruction to the disposing unit 20 based on a judged result (judged data) determined by the judging unit 40 when the disposing unit 20 terminates the disposing operation.

The disposing unit 20 is configured to dispose the recording media based on the input disposing instruction (B03). In addition, the disposing unit 20 is configured to stop (terminate) the disposing operation based on the input disposing termination instruction. Specifically, the disposing unit 20 moves or stops the guide members 22 based on the disposing instruction and the disposing termination instruction utilizing the guide driver 23.

The detector 30 is configured to detect the recording media loaded on the disposing unit 20 (the loading member 21) based on the input detecting instruction (B04). In addition, the detector 30 is configured to detect ends of the recording media disposed (loaded) on the disposing unit 20 (the loading member 21) based on the input detecting instruction. Further, the detector 30 outputs the detected result (detected data) to the judging unit 40 and/or the storage unit 50.

The judging unit 40 is configured to judge a loaded state based on the input detected result (detected data) (B05). The judging unit 40 may, for example, be able to judge whether the ends of the plurality of the loaded (disposed) recording media are aligned based on the detected result detected by the detector 30. Further, the judging unit 40 outputs the judged result (judged data) to the storage unit 50 and/or the controller 10. Note that the judging unit 40 may judge the loaded state by further utilizing tables, mathematical formulas, programs, or the like stored in the storage unit 50.

The storage unit 50 stores information associated with the operations of the disposing unit 20, the detected result of the detector 30, and the judged result of the judging unit 40 (B06). Further, the storage unit 50 may output the stored information via the I/F unit 60.

Recording Media Disposing Operation

A recording media disposing operation performed by the recording media loading device 100 (see FIG. 1) is illustrated with reference FIGS. 3A to 3D. Note that the recording media disposing operation involves an operation to dispose the recording media by aligning the ends of the recording media.

Figure 3A:
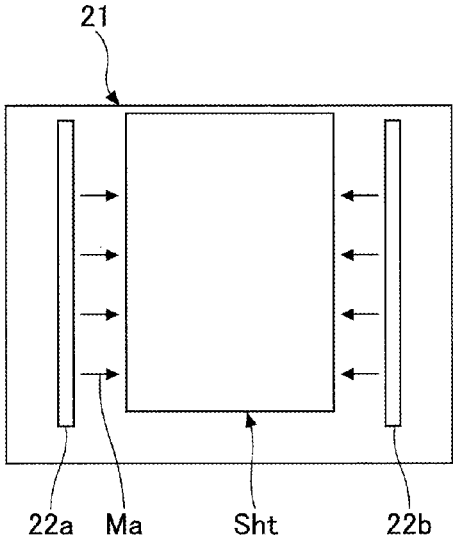
FIGS. 3A to 3D are diagrams illustrating an example of operations of the loading device for recording media according to the embodiment.

As illustrated in FIG. 3A, in the loading device 100 according to the embodiment, recording media Sht are initially loaded (disposed) by a user in an interval between a pair of guide members 22*a* and 22*b* (a loading step). At this moment, the loading device 100 detects that the recording media Sht have been loaded on the loading member 21 utilizing the medium detector 31 (see FIG. 1) of the detector 30 (a detecting step).

In addition, the loading device 100 according to the embodiment moves the guide members 22*a* and 22*b* in width directions of the recording media Sht utilizing the guide driver 23 (see "Ma" in FIG. 3A). At this moment, the loading device 100 detects respective positions of the guide members 22*a* and 22*b* utilizing the end detector (see FIG. 1) of the detector 30 when the recording media Sht have been in contact with the guide members 22*a* and 22*b*. Hence, the loading device 100 may be able to detect the ends (i.e., end positions) of the recording media based on the detected respective positions of the guide members 22*a* and 22*b*.

Further, the loading device 100 according to the embodiment moves the guide members 22*a* and 22*b* utilizing the guide driver 23 after the recording media Sht have been in contact with the guide members 22*a* and 22*b*. Hence, the loading device 100 may be able to cause the recording media Sht to form flexures (an adjusting step).

Figure 3B:
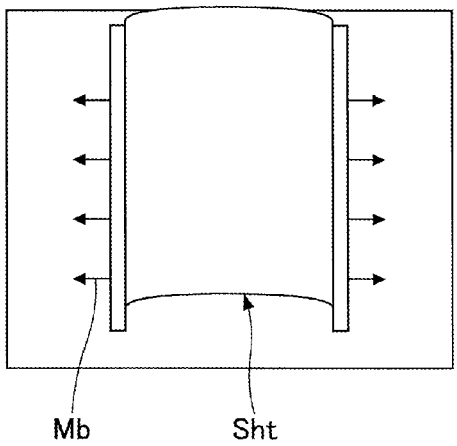

Subsequently, as illustrated in FIG. 3B, the loading device 100 according to the embodiment moves the guide members 22*a* and 22*b* in directions in which the guide members 22*a* and 22*b* are separated from the recording media Sht utilizing the guide driver 23 (see "Mb" in FIG. 3B). At this moment, the recording media Sht are separated from the guide members 22*a* and 22*b*. That is, the recording media Sht having formed the flexures are released such that the recording media Sht are flattened.

Figure 3C:
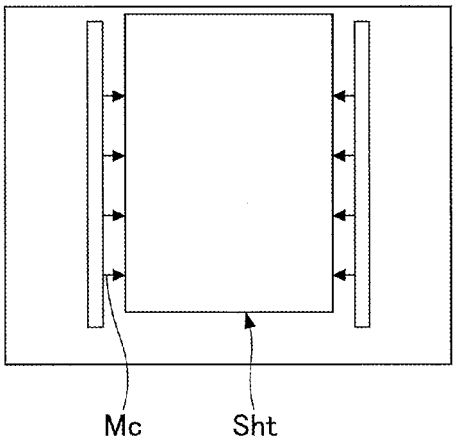

Subsequently, as illustrated in FIG. 3C, the loading device 100 according to the embodiment moves the guide members 22*a* and 22*b* again in the width directions of the recording media Sht utilizing the guide driver 23 (see "Mc" in FIG. 3C).

Figure 3D:
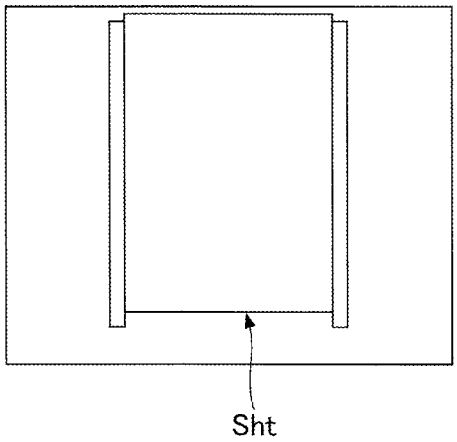

Thereafter, as illustrated in FIG. 3D, the loading device 100 according to the embodiment disposes the guide members 22*a* and 22*b* at a position at which the guide members 22*a* and 22*b* are in contact with the recording media Sht utilizing the guide driver 23, and then stop operating.

Note that the loading device 100 according to the embodiment may be able to repeat the above-described operations illustrated in FIGS. 3A to 3D (the adjusting step). That is, the loading device 100 may repeat moving the guide members 22*a* and 22*b* toward the recording media Sht, and repeat separating the guide members 22*a* and 22*b* from the recording media Sht based on the number of loaded recording media Sht, and moving amounts of the guide members 22*a* and 22*b* and/or the number of times the recording media Sht are caused to form the flexures determined based on the thickness and/or the material of the loaded recording media Sht. The loading device 100 according to the embodiment is able to cause the recording media Sht to form flexures a plurality of times. Hence, the loading device 100 according to the embodiment may be able to repeat causing the recording media Sht to form the flexures and then allowing the recording media Sht to flatten (release) the flexures until the ends of the recording media Sht are in an aligned state.

Program of Loading Device Control Method and Recording Medium Storing Such Program A program Pr of a control method of the loading device according to an embodiment includes a loading step to load recording media in an interval between a pair of guide members mounted on a loading member; a detecting step to detect the recording media loaded on the loading member; and an adjusting step to adjust positions of the guide members in a width direction. In the detecting step, the guide members are moved in width directions of the recording media to cause the guide members to be in contact with the recording media, and the ends of the recording media are detected based on positions of the guide members when being in contact with the recording media. In the adjusting step, the guide members are moved in the width directions of the recording media again so as to cause the recording media to form flexures after causing the guide members to be in contact with the recording media in the detecting step, and the guide members are then disposed at respective positions at which the guide members are in contact with the recording media. The program having the above configuration may be able to exhibit an effect similar to that obtained in the loading device 100 according to the embodiment.

In addition, an embodiment may be a non-transitory computer-readable recording medium Md storing the program Pr. Examples of the non-transitory recording medium Md include a flexible disk (FD), a compact disk read-only memory (CD-ROM), a memory card, and other computer-readable media.

As described above, the recording media loading device 100 according to the embodiment may be able to cause the loaded recording media to form flexures utilizing the guide members 22. Hence, the recording media loading device 100 may be able to dispose the recording media by aligning the ends of the recording media. In addition, the loading device 100 according to the embodiment may be able to detect the recording media that have been loaded, and the positions of the ends of the loaded recording media utilizing the detector 30. Hence, the loading device 100 according to the embodiment may be able to repeat causing the recording media to form the flexures and then allowing the recording media to flatten (release) the flexures until the ends of the recording media are in the aligned state. In addition, the loading device 100 according to the embodiment may be able to determine the moving amounts of the guide members 22 and the number of times the loaded recording media are caused to form flexures based on the number of recording media and the thickness and/or the material of the loaded recording media recorded in the storage unit 50. Hence, the loading device 100 according to the embodiment may be able to repeat causing the recording media to form the flexures and flatten (release) the flexures of the recording media until the ends of the recording media are in the aligned state. That is, the loading device 100 according to the embodiment may be capable of loading (disposing) the recording media by accurately aligning the ends of the recording media.

In the following, a description is given of embodiments applied to a loading device for recording media (hereinafter simply referred to as a "loading device") mounted on an image forming apparatus.

First Embodiment

Initially, a description is given of a recording media loading device 100E according to a first embodiment.

Configuration of Loading Device

A schematic configuration diagram of the recording media loading device 100E according to the first embodiment is illustrated in FIG. 1.

As illustrated in FIG. 1, a configuration of the loading device 100E according to the first embodiment is basically similar to that of the loading device 100 according to the above-described embodiment. Hence, parts of the loading device 100E according to the first embodiment differing from those of the loading device 100 according to the above-described embodiment are mainly described below.

Figure 4A:
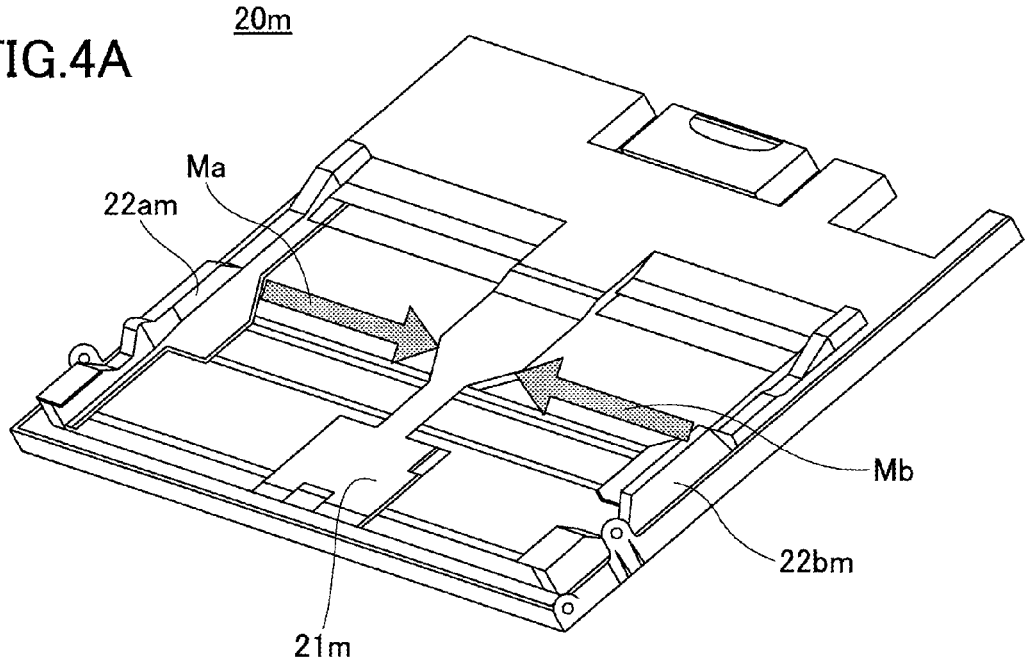
FIGS. 4A and 4B are schematic external views illustrating an example of the loading device for recording media according to a first embodiment.
Figure 4B:
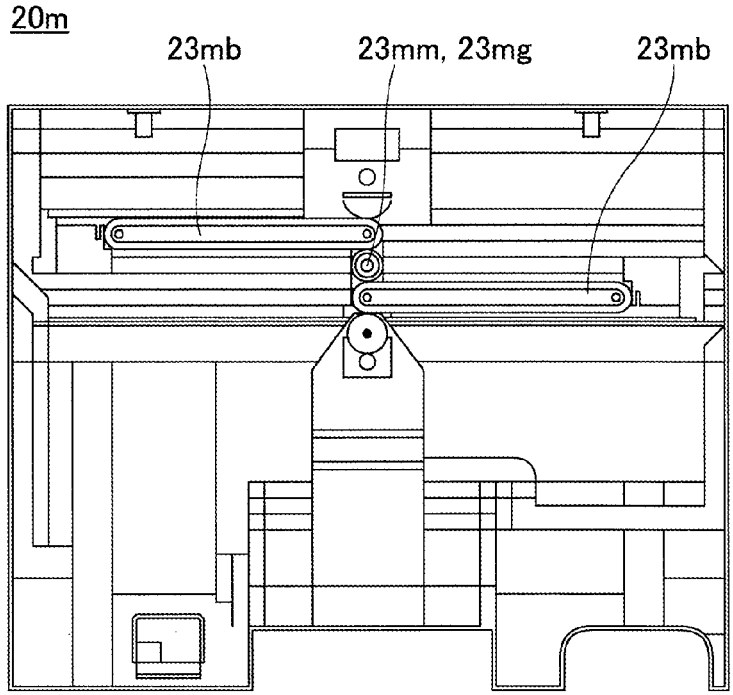

FIGS. 4A and 4B illustrate schematic external views of the loading device 100E according to the first embodiment. More specifically, FIG. 4A is a perspective view of a disposing unit 20 (i.e., a manual bypass unit 20*m*). FIG. 4B is a bottom plan view of the disposing unit 20 (i.e., the manual bypass unit 20*m*).

As illustrated in FIG. 4A, the loading device 100E according to the first embodiment includes the manual bypass unit 20*m* mounted on an image forming apparatus as the disposing unit 20 (see FIG. 1). Note that in the first embodiment, a user manually inserts (loads) a sheet or sheets (i.e., a recording medium/recording media) on the manual bypass unit 20*m*. Note that an image or images are to be formed on the sheet or sheets.

The manual bypass unit 20*m* according to the first embodiment further includes a sheet loading stand 21*m* as the loading member 21 (see FIG. 1). The manual bypass unit 20*m* according to the first embodiment further includes side fences 22*am* and 22*bm* as the guide members 22 (see FIG. 1). The manual bypass unit 20*m* according to the first embodiment further includes a drive motor 23*mm*, a drive gear 23*mg*, and drive belts 23*mb* as the guide driver 23 (see FIG. 1).

The loading device 100E (i.e., the manual bypass unit 20*m*) according to the first embodiment is configured to turn the drive belts 23*mb* looped to contact the drive gear 23*mg* utilizing the drive motor 23*mm*. Hence, the loading device 100E (the manual bypass unit 20*m*) according to the first embodiment may be able to move the side fences 22*am* and 22*bm* by being driven by the drive belts 23*mb* (see "Ma" and "Mb" in FIG. 4A). Further, the loading device 100E (the manual bypass unit 20*m*) according to the first embodiment may be able to adjust a position of the inserted sheets by moving the side fences 22*am* and 22*bm*.

The loading device 100E according to the first embodiment further includes a first pressure-sensitive sensor (not illustrated) disposed on the sheet loading stand 21*m* as the medium detector 31 of the detector (see FIG. 1). The loading device 100E according to the first embodiment further includes a second pressure-sensitive sensor (not illustrated) disposed on the side fences 22*am* and 22*bm* as the end detector 32 of the detector 30 (see FIG. 1).

Note that the controller 10 (see FIG. 1) of the loading device 100E according to the first embodiment may be a controller included in the image forming apparatus (e.g., a processor (CPU), a storage unit (RAM, ROM, EEPROM, and hard disk), a communications unit, etc.).

Functionality of Loading Device

A functional block diagram of the recording media loading device 100E according to the first embodiment is illustrated in FIG. 2.

As illustrated in FIG. 2, a function of the loading device 100E according to the first embodiment is basically similar to that of the above-described embodiment. Hence, a description of parts of the loading device 100E according to the first embodiment similar to those of the loading device 100 according to the above-described embodiment is omitted from the specification.

Sheet Position Adjusting Operation

A sheet position adjusting operation performed by the recording media loading device 100E according to the first embodiment is described with reference to FIG. 5, and FIGS. 6A to 6E. Note that the sheet position adjusting operation involves an operation to dispose the sheets by aligning the ends of the sheets.

Figure 5:
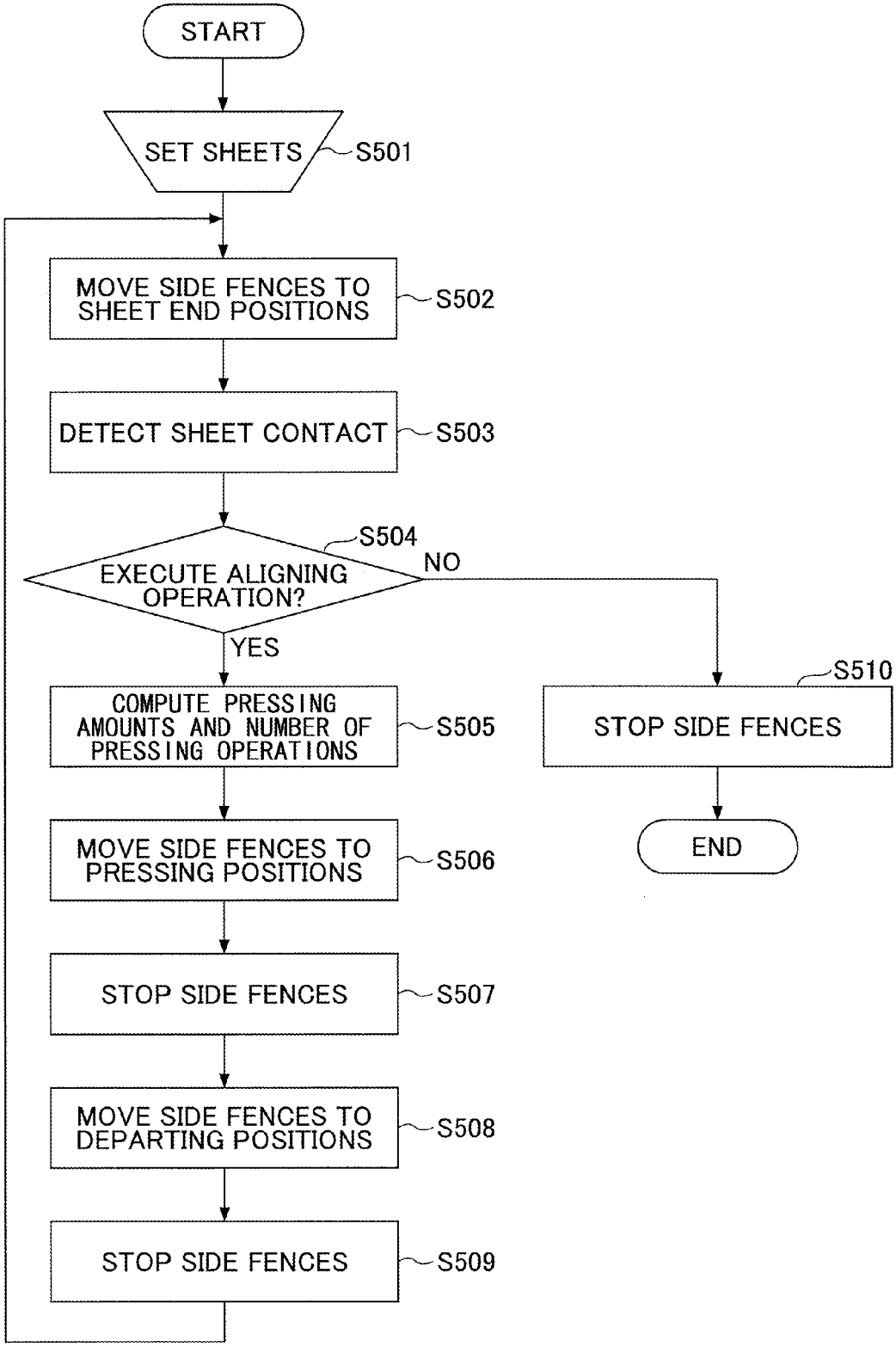
FIG. 5 is a flowchart illustrating an example of operations of the loading device for recording media according to the first embodiment.

As illustrated in FIG. 5, in step S501, the loading device 100E according to the embodiment receives sheets Sht, which are loaded (disposed) by a user, in an interval between side fences 22*am* and 22*bm* (positions "Pa" in FIG. 6A) of the sheet loading stand 21*m*. Further, the loading device 100E detects that the sheets Sht have been loaded on the sheet loading stand 21*m* utilizing the first pressure-sensitive sensor (the medium detector 31) disposed on the sheet loading stand 21*m*. The loading device 100E then proceeds with step S502.

In step S502, the loading device 100E moves the side fences 22*am* and 22*bm* toward ends of the sheets Sht utilizing the drive motor 23*mm* or the like (see "Mb" in FIG. 3B). The loading device 100E then proceeds with step S503.

Figure 6A:
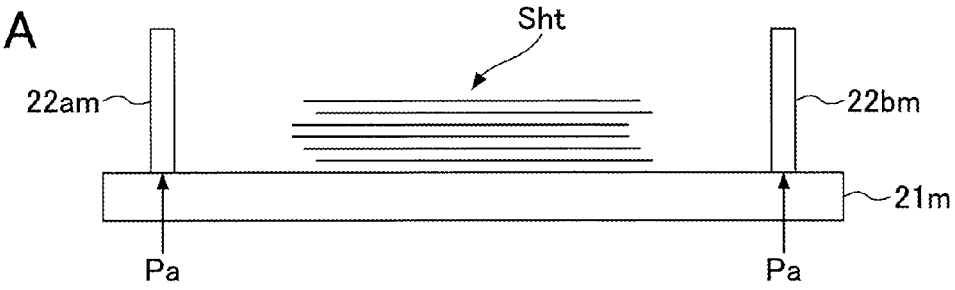
FIGS. 6A to 6E are diagrams illustrating an example of operations of the loading device for recording media according to the first embodiment.
Figure 6B:
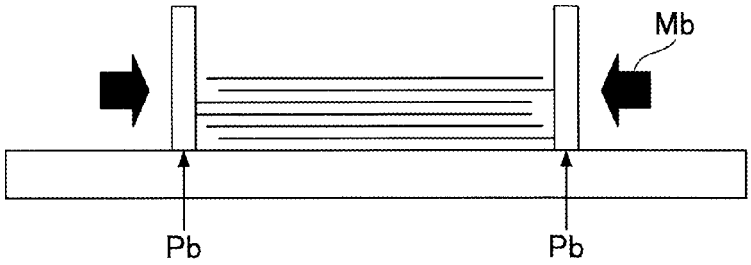

In step S503, the loading device 100E detects the ends of the sheets Sht utilizing the second pressure-sensitive sensor (the end detector 32) disposed on the side fences 22*am* and 22*bm* (see positions "Pb" in FIG. 6B). Further, the loading device 100E detects the ends of the sheets Sht based on amounts of the side fences 22*am* and 22*bm* to be moved to the positions at which the ends of the sheets are detected (hereinafter simply called "moving amounts" of the side fences 22*am* and 22*bm*", each of which is obtained by "Pa−Pb") (the manual bypass unit 20*m*). That is, the positions of the ends of the sheets Sht are specified. The loading device 100E then proceeds with step S504.

Note that the positions of the side fences 22*am* and 22*bm* may be computed based on a driving amount of the drive motor 23*mm*, may directly be detected by encoders, or may be detected by other position detecting methods.

In step S504, the loading device 100E judges whether the ends of the loaded sheets are aligned (in an aligned state) utilizing the judging unit 40 (see FIG. 1). That is, the loading device 100E judges whether to perform the operation to align the ends of the loaded sheets by utilizing the judging unit 40.

Specifically, the judging unit 40 may be able to judge whether to perform the operation to align the ends of the sheets Sht based on information about the number of sheets, the thickness or the material of the sheets stored in the storage unit 50 (see FIG. 1), or information input by the I/F unit 60 (see FIG. 1). When the loading device 100E performs the operation to align the ends of the sheets Sht, the loading device 100E proceeds with step S505. Otherwise, the loading device 100E proceeds with step S510.

In step S505, the loading device 100E computes pressing amounts of the side fences 22*am* and 22*bm* (i.e., moving amounts of the side fences 22*am* and 22*bm*) and the pressing number of times (the number of times the sheets Sht are caused to form flexures). The controller 10 may be able to compute the pressing amounts based on the number of sheets Sht, and the thickness and the material of the sheets Sht stored in the storage unit 50. Alternatively, the controller 10 may be able to compute the pressing amounts by utilizing tables, mathematical formulas, programs, or the like stored in advance in the storage unit 50.

Specifically, the controller 10 may be able to compute the pressing amounts based on the type of sheets (recording media), and the thickness of the sheets (thickness of recording media) utilizing the following TABLE 1. The controller 10 may be able to select (compute) the number of pressing times based on the type of sheets (recording media), and the thickness of the sheets (thickness of recording media) utilizing the following TABLE 2.

After the computation, the loading device 100E then proceeds with step S506.

TABLE 1

| TYPE/ THICKNESS | THIN ← THICKNESS 1 | THICKNESS 2 | THICKNESS 3 → THICK |
|---|---|---|---|
| STANDARD PAPER | 20 mm | 15 mm | 10 mm |
| RECYCLED PAPER | 20 mm | 15 mm | 10 mm |
| COATED PAPER | 15 mm | 10 mm | 10 mm |
| OHP | 10 mm | 10 mm | 10 mm |

TABLE 2

| TYPE/ THICKNESS | THIN ← THICKNESS 1 (number of times) | THICKNESS 2 (number of times) | THICKNESS 3 (number of times) → THICK |
|---|---|---|---|
| STANDARD PAPER | 6 | 4 | 2 |
| RECYCLED PAPER | 6 | 4 | 2 |
| COATED PAPER | 5 | 3 | 2 |
| OHP | 3 | 2 | 2 |

Figure 6C:
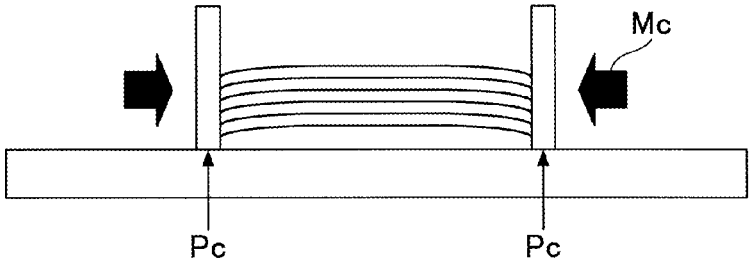

In step S506, the loading device 100E moves the side fences 22*am* and 22*bm* in directions in which the sheets Sht form flexures (e.g., widths directions of the sheets) utilizing the drive motor 23*mm* or the like (see "Mc" in FIG. 6C). The loading device 100E then proceeds with step S507.

In step S507, the loading device 100E stops the side fences 22*am* and 22*bm* utilizing the drive motor 23*mm* or the like (see "Pc" in FIG. 6C). The loading device 100E then proceeds with step S508.

Figure 6D:
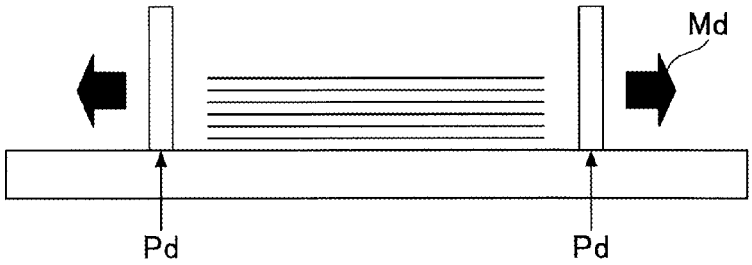

In step S508, the loading device 100E moves the side fences 22*am* and 22*bm* in directions in which the formed flexures of the sheets Sht are released or flattened (relaxed) (e.g., in directions opposite to the width directions of the sheets in step S506) utilizing the drive motor 23*mm* or the like (see "Md" in FIG. 6D). At this moment, the side fences 22*am* and 22*bm* are separated from the sheets Sht. The loading device 100E then proceeds with step S509.

In step S509, the loading device 100E stops the side fences 22*am* and 22*bm* at the positions separated from the sheets Sht utilizing the drive motor 23*mm*. The loading device 100E then proceeds with step S502 (back to step S502).

Figure 6E:
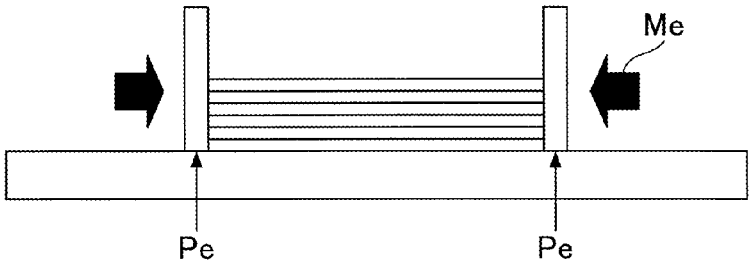
Figure 7A:
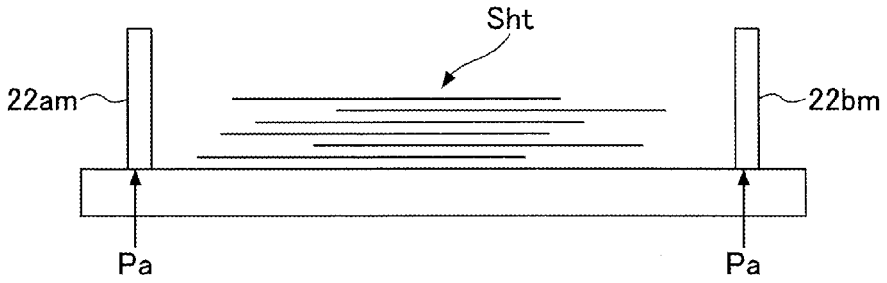
FIGS. 7A to 7F are diagrams illustrating an example of operations of a loading device for recording media according to a first modification of the first embodiment.
Figure 7B:
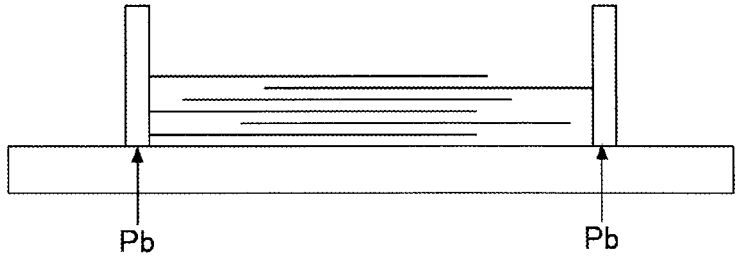
Figure 7C:
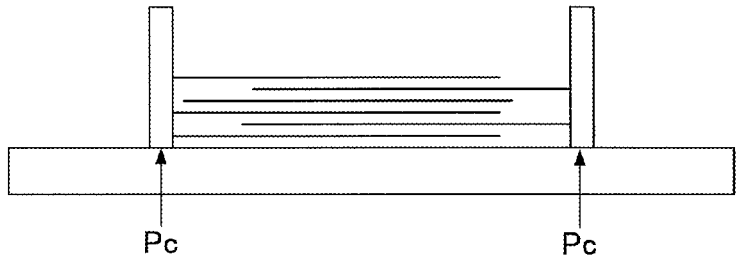
Figure 7D:
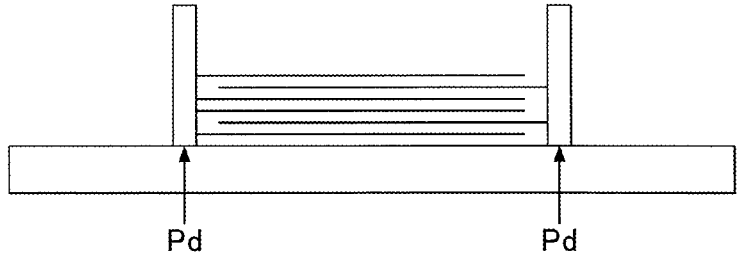
Figure 7E:
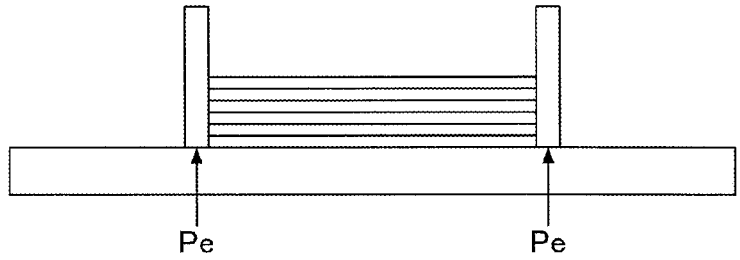
Figure 7F:
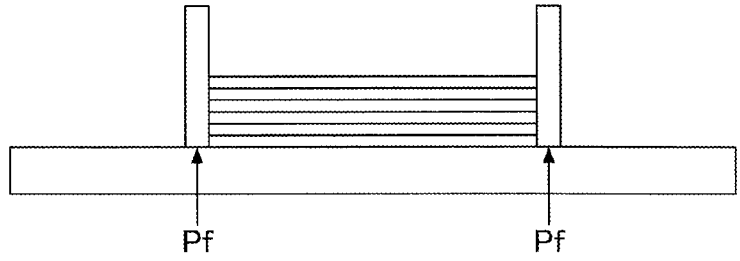
Figure 8A:
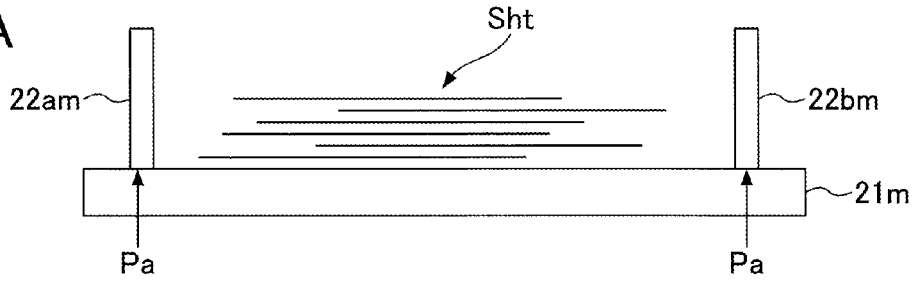
FIGS. 8A to 8E are diagrams illustrating an example of operations of a loading device for recording media according to a second modification of the first embodiment.
Figure 8B:
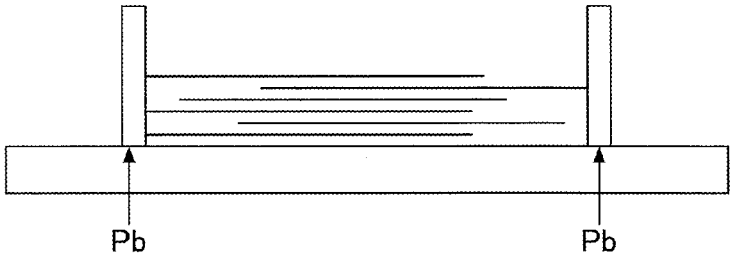
Figure 8C:
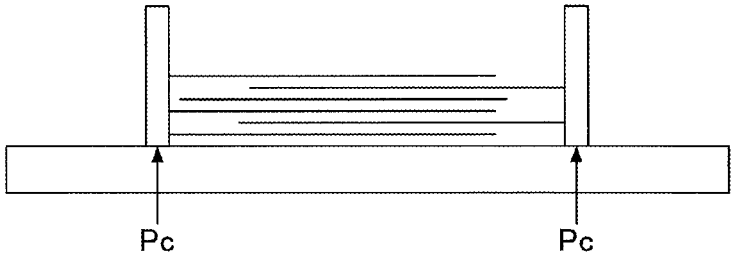
Figure 8D:
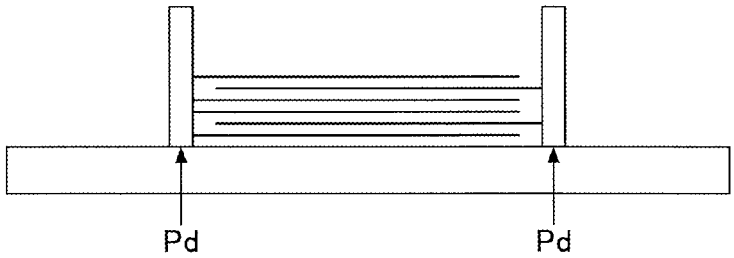
Figure 8E:
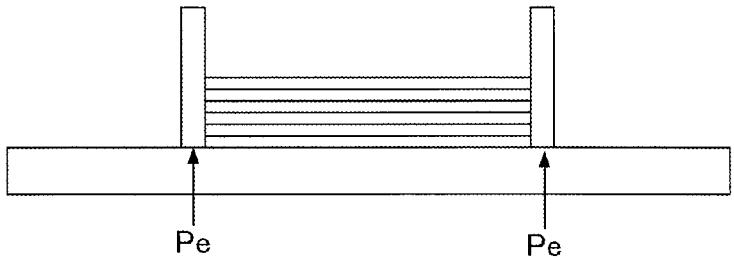

On the other hand, in step S510, the loading device 100E stops the side fences 22*am* and 22*bm* at the positions in contact with the sheets Sht utilizing the drive motor 23*mm* or the like (see "Pe" in FIG. 6E). The loading device 100E then ends the sheet position adjusting operation (see "END" in FIG. 5).

As described above, the recording media loading device 100E according to the first embodiment may be able to cause the loaded sheets (recording media) to form flexures utilizing the side fences 22*am* and 22*bm* (the guide members 22). Hence, the recording media loading device 100E may be able to dispose the sheets in the manual bypass unit 20*m* by aligning the ends of the sheets. In addition, the loading device 100E according to the first embodiment may be able to detect the sheets that have manually been loaded (inserted) in the manual bypass unit 20*m*, and the positions of the ends of the loaded sheets utilizing the detector 30. Hence, the loading device 100E according to the first embodiment may be able to repeat causing the sheets to form the flexures and flattening (releasing) or relaxing the flexures of the sheets until the ends of the sheets are in the aligned state. In addition, the loading device 100E according to the first embodiment may be able to determine the pressing amounts of the side fences 22*am* and 22*bm* and the number of times the sheets form flexures based on the number of the sheets, and the thickness and/or the material of the loaded sheets. Hence, the loading device 100E according to the first embodiment may be able to repeat causing the sheets to form the flexures and flattening (i.e., releasing or relaxing) the flexures of the sheets until the ends of the sheets are in the aligned state. That is, the loading device 100E according to the first embodiment may be able to dispose the sheets in the manual bypass unit 20*m* by accurately aligning the ends of the sheets. Hence, the loading device 100E according to the first embodiment may be able to prevent the sheets from being skewed, jamming, failing to be transferred, being misaligned, or the like when forming images on the sheets manually inserted in the manual bypass unit 20*m*.

In addition, the loading device 100E according to the first embodiment may be able to obtain effects similar to those obtained by the loading device 100 according to the aforementioned embodiment.

First Modification of First Embodiment

Next, a description is given of a loading device 110E according to a first modification of the first embodiment.

Configuration and Functionality of Loading Device

A schematic configuration diagram of the loading device 110E according to a first modification of the first embodiment is illustrated in FIG. 1 and the like.

As illustrated in FIG. 1 and the like, a configuration or the like of the loading device 110E according to the first modification of the first embodiment is basically similar to that of the loading device 100E according to the first embodiment. Hence, a description of parts of the first modification similar to those of the first embodiment is omitted from the specification.

Sheet Position Adjusting Operation

A sheet position adjusting operation performed by the recording media loading device 110E according to the first modification is described with reference to FIG. 5, and FIGS. 7A to 7F. Note that the sheet position adjusting operation involves an operation to dispose the sheets by aligning the ends of the sheets.

As illustrated in FIG. 5, the loading device 110E according to the first modification detects the ends of the sheets Sht utilizing the second pressure-sensitive sensor (the end detector 32) disposed on the side fences 22*am* and 22*bm* (see positions "Pb" in FIG. 7B) in steps S501 to S503 in a manner similar to the loading device 100E according to the first embodiment. The loading device 110E then proceeds with step S504.

In step S504, the loading device 110E judges whether the ends of the loaded sheets are aligned (in an aligned state) utilizing the judging unit 40 (see FIG. 1). Note that the judging unit 40 is configured to judge the ends of the plurality of the manually inserted sheets as being in an aligned state when the difference between a first end position initially detected by the second pressure-sensitive sensor (the end detector 32) and a second end position subsequently detected by the second pressure-sensitive sensor is within a predetermined threshold. Note that the first end position is detected by the end detector 32 when the side fences 22*am* and 22*bm* are initially moved, and the second end position is detected by the second pressure-sensitive sensor when the side fences 22*am* and 22*bm* are subsequently moved.

Specifically, the judging unit 40 may be able to judge the ends of the plurality of the manually inserted sheets Sht as being in the aligned state when the difference between the first position and the second position is ±1 mm or less. Further, the judging unit 40 may be able to judge the ends of the plurality of the manually inserted sheets Sht as being in a non-aligned state when the difference between the first position and the second position exceeds ±1 mm.

When the judging unit 40 judges the ends of the manually inserted sheets Sht as being in the non-aligned state (i.e., when the operation to align the ends of the sheets Sht is to be executed (continued)), the loading device 110E proceeds with step S505. Otherwise, the loading device 110E proceeds with step S510.

Other operations of the loading device 110E according to the first modification are basically similar to those of the loading device 100E according to the first embodiment. Hence, a description of parts of the first modification similar to those of the first embodiment is omitted from the specification.

As described above, the loading device 110E according to the first modification may be able to obtain effects similar to those obtained by the loading device 100E according to the first embodiment.

Second Modification of First Embodiment

Next, a description is given of a loading device 120E according to a second modification of the first embodiment.

Configuration and Functionality of Loading Device

A schematic configuration diagram of the loading device 120E according to a second modification of the first embodiment is illustrated in FIG. 1 and the like.

As illustrated in FIG. 1 and the like, a configuration or the like of the loading device 120E according to the second modification of the first embodiment is basically similar to that of the loading device 100E according to the first embodiment. Hence, a description of parts of the second modification similar to those of the first embodiment is omitted from the specification.

Sheet Position Adjusting Operation

A sheet position adjusting operation performed by the recording media loading device 120E according to the second modification is described with reference to FIG. 5, and FIGS. 8A to 8E. Note that the sheet position adjusting operation involves an operation to dispose the sheets by aligning the ends of the sheets.

As illustrated in FIG. 5, the loading device 120E according to the second modification detects the ends of the sheets Sht utilizing the second pressure-sensitive sensor (the end detector 32) disposed on the side fences 22*am* and 22*bm* (see positions "Pb" in FIG. 8B) in steps S501 to S503 in a manner similar to the loading device 100E according to the first embodiment. The loading device 120E then proceeds with step S504.

In step S504, the loading device 120E judges whether the ends of the loaded sheets are aligned (in an aligned state) utilizing the judging unit 40 (see FIG. 1). Note that the judging unit 40 is configured to judge the ends of the plurality of the manually inserted sheets as being in an aligned state when the difference between a first end position (e.g., the position Pb in FIG. 8B, Pc in FIG. 8C, or Pe in FIG. 8E) detected by the second pressure-sensitive sensor (the end detector 32) and a second end position determined based on the size of the sheets Sht input via the I/F unit 60 (see FIG. 1) is within a predetermined threshold. Note that the first end position is detected by the end detector 32 when the side fences 22*am* and 22*bm* are moved.

Specifically, the judging unit 40 may be able to judge the ends of the plurality of the manually inserted sheets as being in the aligned state when the difference between the first position and the second position is ±1 mm or less. Further, the judging unit 40 may be able to judge the ends of the plurality of the manually inserted sheets as being in a non-aligned state when the difference between the first position and the second position exceeds ±1 mm.

When the judging unit 40 judges the ends of the manually inserted sheets Sht as being in the non-aligned state (i.e., when the operation to align the ends of the sheets Sht is to be executed (continued)), the loading device 120E proceeds with step S505. Otherwise, the loading device 120E proceeds with step S510.

Other operations of the loading device 120E according to the second modification are basically similar to those of the loading device 100E according to the first embodiment. Hence, a description of parts of the second modification similar to those of the first embodiment is omitted from the specification.

As described above, the recording media loading device 120E according to the second modification may be able to judge whether the loaded sheets are aligned (in the aligned state) based on the size of the sheets input via the I/F unit 60. Hence, the recording media loading device 120E may be able to dispose the sheets in the manual bypass unit 20*m* by aligning the ends of the sheets. That is, the recording media loading device 120E according to the second modification may, compared to the loading device 110E according to the first modification of the first embodiment, be able to dispose the sheets in the manual bypass unit 20*m* by aligning the ends of the sheets with the pressing number of times one less than the pressing number of times of the loading device 110E according to the first modification. Further, the recording media loading device 120E according to the second modification may be able to quickly move the side fences 22*am* and 22*bm* to the respective positions corresponding to the size of the sheets based on the size of the sheets input via the I/F unit 60. Hence, the recording media loading device 120E may be able to reduce in the time required to dispose the sheets in the manual bypass unit 20*m* by aligning the ends of the sheets.

Further, the loading device 120E according to the second modification may be able to obtain effects similar to those obtained by the loading device 100E according to the first embodiment.

Third Modification of First Embodiment

Next, a description is given of a loading device 130E according to a third modification of the first embodiment.

Configuration and Functionality of Loading Device

A schematic configuration diagram of the loading device 130E according to the third modification of the first embodiment is illustrated in FIG. 1 and the like.

As illustrated in FIG. 1 and the like, a configuration or the like of the loading device 130E according to the third modification of the first embodiment is basically similar to that of the loading device 100E according to the first embodiment. Hence, a description of parts of the third modification similar to those of the first embodiment is omitted from the specification.

Figure 9:
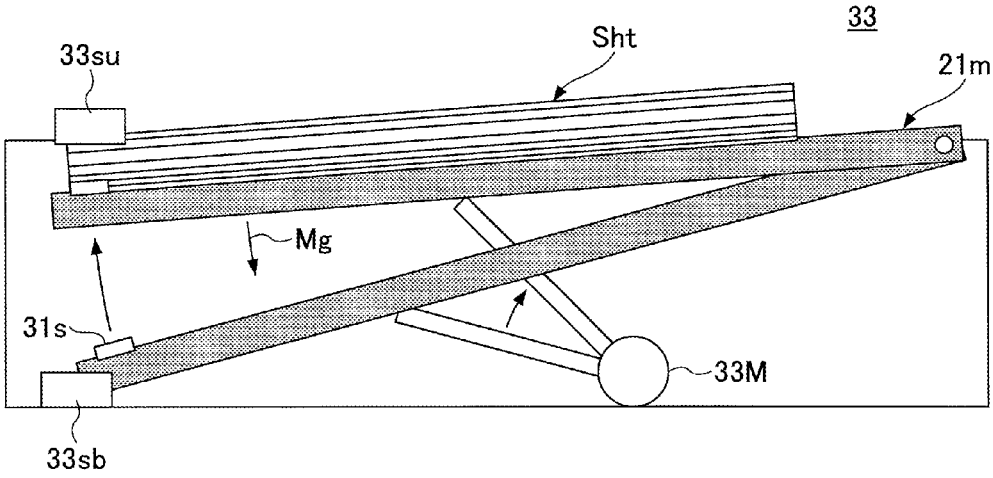
FIG. 9 is a diagram illustrating an example of a detector of a loading device for recording media according to a third modification of the first embodiment.

FIG. 9 illustrates an example of the loading device 130E according to the third modification.

As illustrated in FIG. 9, the loading device 130E according to the third modification further includes a loading amount detector 33 configured to detect the amount of sheets manually loaded (herein after also called the "loading amount") by the user in the manual bypass unit 20*m* as the detector 30 (see FIG. 1). Note that the loading amount detector 33 used in the third modification includes an upper-limit sensor 33*su*, a lower-limit sensor 33*sb*, and a lifting motor 33M.

The loading amount detector 33 according to the third modification is configured to detect the sheets having been manually loaded on a sheet loading stand 21*m* utilizing the lower-limit sensor 33*sb*. Specifically, in the manual bypass unit 20*m*, the sheet loading stand 21*m* moves in a downward direction (see "Mg" in FIG. 9) when the sheets are manually inserted in the sheet loading stand 21*m*. Hence, the lower-limit sensor 33*sb* is in contact with the sheet loading stand 21*m*. Hence, the loading amount detector 33 may be able to detect the sheets that are manually inserted in the sheet loading stand 21*m* by detecting the lower-limit sensor 33*sb* being in contact with the sheet loading stand 21*m*.

The loading amount detector 33 according to the third modification is also configured to cause the sheets on the sheet loading stand 21*m* to be in contact with the upper-limit sensor 33*su* utilizing the lift motor 33M. The loading amount detector 33 may be able to detect the driving amount of the lift motor 33M when the upper-limit sensor 33*su* is in contact with the sheets Sht. Hence, the loading amount of the sheets manually inserted in the sheet loading stand 21*m* may detected based on the detected driving amount of the lift motor 33M.

Sheet Position Adjusting Operation

A sheet position adjusting operation performed by the recording media loading device 130E according to the third modification is described with reference to FIG. 5. Note that the sheet position adjusting operation involves an operation to dispose the sheets by aligning the ends of the sheets.

As illustrated in FIG. 5, the loading device 130E according to the third modification judges whether the ends of the sheets Sht are aligned (in a aligned state) utilizing the judging unit 40 (see FIG. 1) in steps S501 to S504 in a manner similar to the loading device 100E according to the first embodiment.

When the judging unit 40 judges the ends of the sheets Sht as being in a non-aligned state (i.e., when the operation to align the ends of the sheets Sht is executed (continued)), the loading device 130E proceeds with step S505. Otherwise, the loading device 130E proceeds with step S510.

In step S505, the loading device 130E computes pressing amounts (i.e., moving amounts of the side fences 22*am* and 22*bm*) and the pressing number of times (the number of times the sheets Sht are allowed to form flexures). The controller 10 may be able to compute the pressing amounts and the number of pressing times based on the loading amount of the sheets (recording media) detected by the loading amount detector 33.

Specifically, the controller 10 may be able to select (compute) the pressing amounts based on the loading amount of the sheets utilizing the following TABLE 3. In addition, the controller 10 may be able to select (compute) the number of pressing times based on the loading amount of the sheets utilizing the following TABLE 4.

After the computation, the loading device 130E then proceeds with step S506.

TABLE 3

| LOADING AMOUNT | PRESSING AMOUNT |
|---|---|
| 3 mm or less | 10 mm |
| ~5 mm | 10 mm |
| ~10 mm | 15 mm |
| ~15 mm | 15 mm |
| ~20 mm | 15 mm |
| ~25 mm | 20 mm |

TABLE 4

| LOADING AMOUNT | ALIGNED TIMES (number of times) |
|---|---|
| 3 mm or less | 2 |
| ~5 mm | 3 |

TABLE 4-continued

| LOADING AMOUNT | ALIGNED TIMES (number of times) |
|---|---|
| ~10 mm | 4 |
| ~15 mm | 5 |
| ~20 mm | 6 |
| ~25 mm | 6 |

Other operations of the loading device 130E according to the third modification are basically similar to those of the loading device 110E according to the first modification of the first embodiment. Hence, a description of parts of the loading device 130E according to the third modification similar to those of the loading device 110E according to the first modification of the first embodiment is omitted from the specification.

As described above, the loading device 130E according to the third modification of the first embodiment may be able to detect the loading amount of the sheets (recording media) utilizing the loading amount detector 33. Hence, the loading device 130E may be able to align the ends of the sheets based on the detected loading amount.

Further, the loading device 130E according to the third modification of the first embodiment may be able to obtain effects similar to those obtained by the loading device 100E according to the first embodiment.

Second Embodiment

In the following, a description is given of a loading device 200E according to a second embodiment.

Configuration of Loading Device

A schematic configuration diagram of the loading device 200E according to the second embodiment is illustrated in FIG. 1.

As illustrated in FIG. 1, a configuration of the loading device 200E according to the second embodiment is basically similar to that of the loading device 100E according to the first modification of the first embodiment. Hence, parts of the loading device 200E according to the second embodiment differing from those of the loading device 100E according to the first modification of the first embodiment are mainly described below.

Figure 10A:
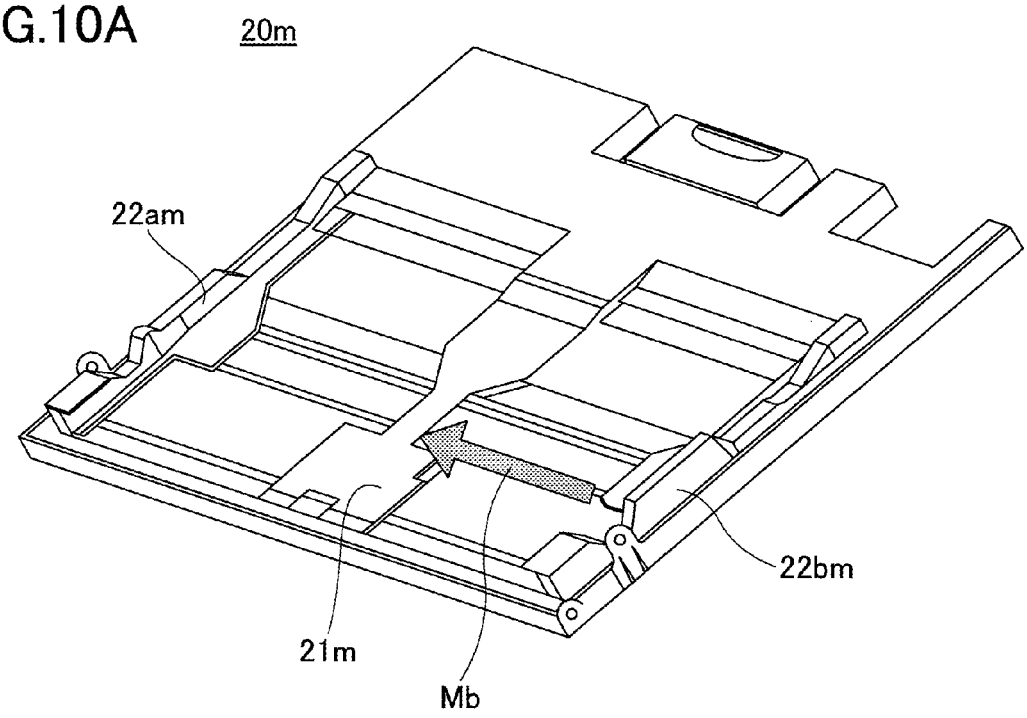
FIGS. 10A and 10B are schematic external views illustrating an example of a loading device according to a second embodiment.
Figure 10B:
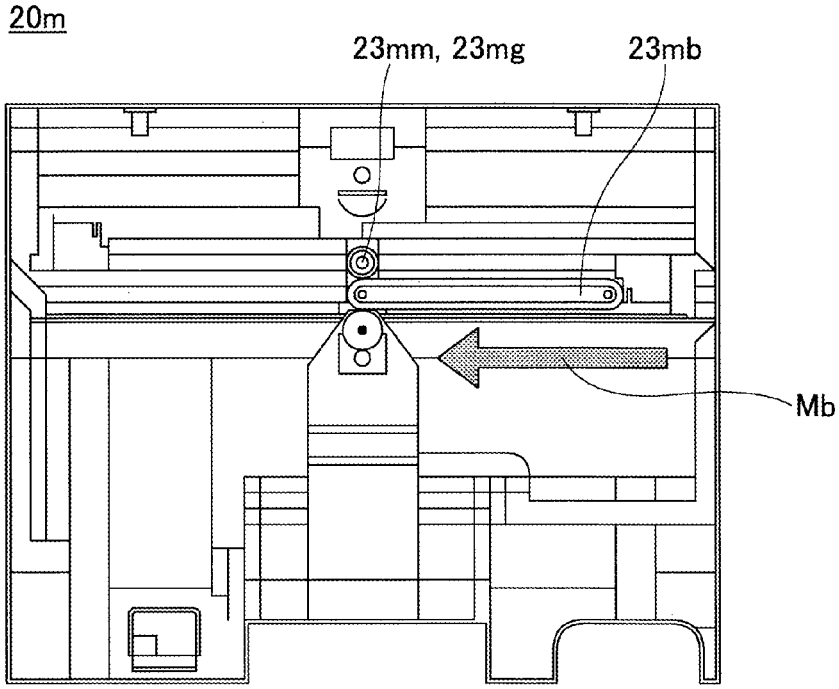

FIGS. 10A and 10B illustrate schematic external views of the loading device 200E according to the second embodiment. Note that FIG. 10A is a perspective view of a disposing unit 20 (i.e., a manual bypass unit 20*m*). FIG. 10B is a bottom plan view of the disposing unit 20 (i.e., the manual bypass unit 20*m*).

As illustrated in FIG. 10A, the loading device 200E according to the second embodiment includes the manual bypass unit 20*m* mounted on an image forming apparatus as the disposing unit 20 (see FIG. 1). Note that in the second embodiment, a user manually inserts (loads) a sheet or sheets (i.e., a recording medium/recording media) on the manual bypass unit 20*m*. Note that an image or images are formed on the sheet or sheets.

The manual bypass unit 20*m* according to the second embodiment further includes a sheet loading stand 21*m* as the loading member 21 (see FIG. 1). The manual bypass unit 20*m* according to the second embodiment further includes side fences 22*am* and 22*bm* as the guide members 22 (see FIG. 1). The manual bypass unit 20*m* according to the second embodiment further includes a drive motor 23*mm*, a drive gear 23*mg*, and a drive belts 23*mb* (see FIG. 10B) as the guide driver 23 (see FIG. 1).

The loading device 200E (the manual bypass unit 20*m*) according to the second embodiment is configured to turn the drive belts 23*mb* looped to contact the drive gear 23*mg* utilizing the drive motor 23*mm*. Hence, the loading device 200E (the manual bypass unit 20*m*) according to the second embodiment may be able to move the side fence 22*bm* driven by the drive belts 23*mb* (see "Mb" in FIGS. 10A and 10B). Further, the loading device 200E (the manual bypass unit 20*m*) according to the second embodiment may be able to adjust a position of the inserted sheets (positions of the inserted sheets) by moving the side fence 22*bm*. The loading device 200E (the manual bypass unit 20*m*) according to the second embodiment further includes a sheet loading stand 21*m* to which the side fence 22*am* is fixed. That is, the loading device 200E (the manual bypass unit 20*m*) according to the second embodiment includes a configuration to move the side fence 22*bm* alone.

The loading device 200E according to the second embodiment further includes a first pressure-sensitive sensor (e.g., 31*s* in FIG. 12) disposed on the sheet loading stand 21*m* as the medium detector 31 of the detector 30 (see FIG. 1). The loading device 200E according to the second embodiment further includes second pressure-sensitive sensors (e.g., 32*a* and 32*b* in FIG. 12) disposed on the side fences 22*am* and 22*bm*, respectively, as the end detector 32 of the detector 30 (see FIG. 1).

Note that the controller 10 (see FIG. 1) of the loading device 200E according to the second embodiment may be a controller included in the image forming apparatus (e.g., a processor (CPU), a storage unit (RAM, ROM, EEPROM, and hard disk), a communications unit, etc.).

Functionality of Loading Device

A functional block diagram of the recording media loading device 200E according to the second embodiment is illustrated in FIG. 2.

As illustrated in FIG. 2, a function of the loading device 200E according to the second embodiment is basically similar to that of the loading device 100 according to the embodiment. Hence, a description of parts of the second embodiment similar to those of the above-described embodiment is omitted from the specification.

Sheet Position Adjusting Operation

A sheet position adjusting operation performed by the recording media loading device 200E according to the second embodiment is described with reference to FIG. 11, and FIGS. 12A to 12D. Note that the sheet position adjusting operation involves an operation to dispose the sheets by aligning the ends of the sheets.

Figure 11:
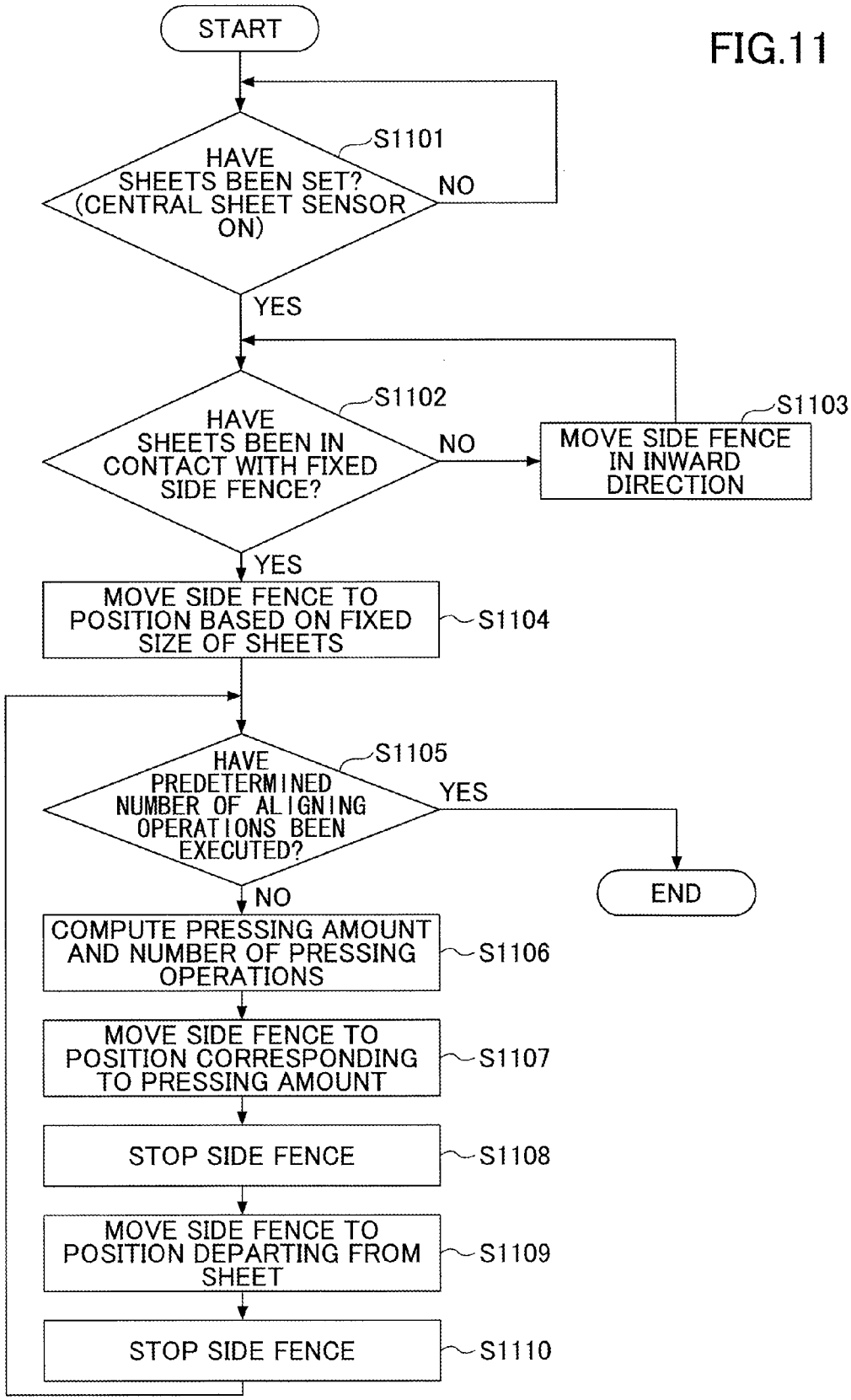
FIG. 11 is a flowchart illustrating an example of operations of the loading device for recording media according to the second embodiment.

As illustrated in FIG. 11, in step S501, the loading device 200E according to the second embodiment initially detects sheets Sht loaded (disposed) by a user on the sheet loading stand 21*m* utilizing the medium detector 31 (see the sensor 31*s* in FIG. 12A) of the detector 30 in step S1101. When the loading device 200E has detected the sheets Sht, the loading device 200E then proceeds with step S1102. Otherwise, the loading device 200E is in a standby mode until the loading device 200E detects the sheets Sht.

In step S1102, the loading device 200E detects the ends of the sheets Sht utilizing the end detector 32 (the sensor 32*a* in FIG. 12A) of the detector 30. When the loading device 200E has detected the sheets Sht, the loading device 200E then proceeds with step S1104. Otherwise, the loading device 200E proceeds with step S1103.

Figure 12A:
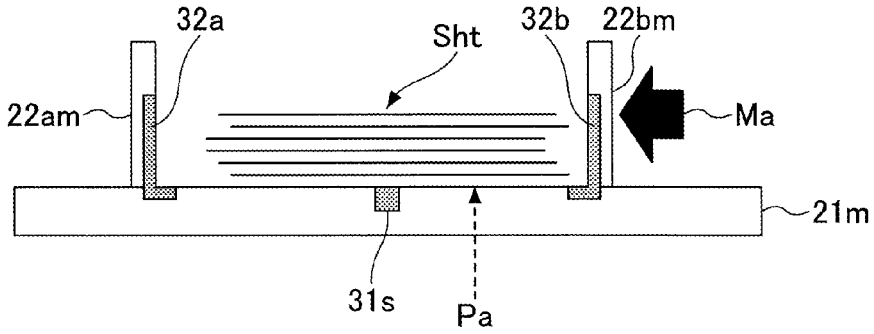
FIGS. 12A to 12D are diagrams illustrating an example of operations of the loading device for recording media according to the second embodiment.

In step S1103, the loading device 200E moves the sheets Sht in a direction toward the side fence 22*am* utilizing the side fence 22*bm* (see "Ma" in FIG. 12A). The loading device 200E then proceeds with step S1102 (back to step S1102).

Figure 12B:
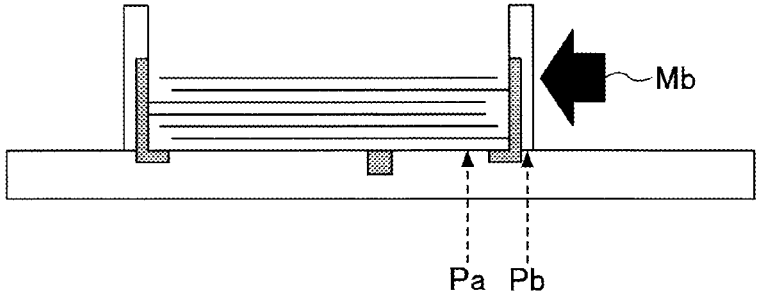
Figure 12C:
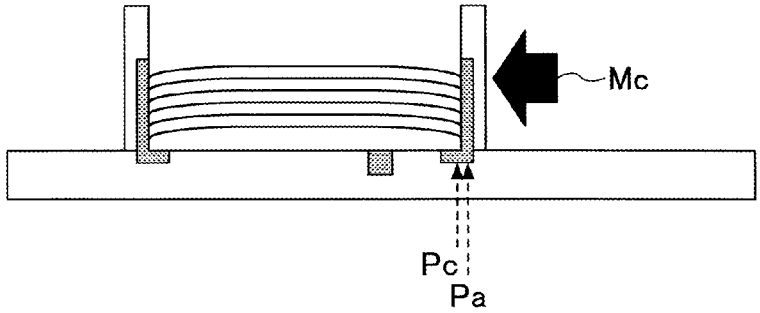

In step S1104, the loading device 200E moves the side fence 22*bm* utilizing the drive motor 23*mm* or the like (see "Mb" in FIG. 12B). Note that the loading device 200E determines a position of the side fence 22*bm* utilizing the media information input in advance (i.e., stored in the storage unit 50) via the I/F unit 60 (FIG. 1). Specifically, the loading device 200E may, for example, be able to move the side fence 22*bm* to a position based on the size of the sheets Sht, such that an interval between the side fences 22*am* and 22*bm* matches the size of the sheets Sht in width directions of the sheets Sht (see a position "Pa" in FIGS. 12A and 12B).

The loading device 200E then proceeds with step S1105.

Figure 12D:
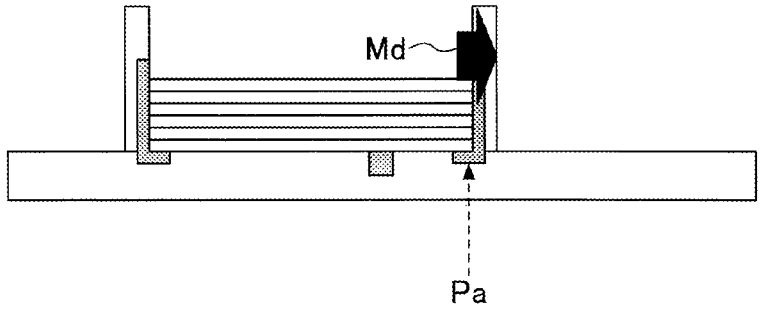

In steps S1105 to S1110, the loading device 200E causes the sheets Sht to form flexures (see "Mc" in FIG. 12), and then the flexures are released (see "Md" in FIG. 12D). Subsequent operations of the loading device 200E according to the second modification are basically similar to those of the loading device 100E according to the first embodiment. Hence, a description of parts of the loading device 200E according to the second embodiment similar to those of the loading device 100E according to the first embodiment is omitted from the specification.

As described above, the recording media loading device 200E according to the second embodiment may be able to cause the loaded sheets (recording media) to form flexures utilizing the side fences 22*am* and 22*bm* (i.e., the guide members 22). Hence, the recording media loading device 200E may be able to dispose the sheets in the manual bypass unit 20*m* by aligning the ends of the sheets. In addition, the loading device 200E according to the second embodiment may be able to detect the sheets that have been manually loaded (inserted) in the manual bypass unit 20*m*, and the positions of the ends of the loaded sheets utilizing the detector 30. Hence, the loading device 200E according to the second embodiment may be able to repeat causing the sheets to form the flexures and flattening (i.e., releasing or relaxing) the flexures of the sheets until the ends of the sheets are in the aligned state. Further, the loading device 200E according to the second embodiment may be able to determine the pressing amount of the side fence 22*bm* and the number of times the sheets form flexures based on the number of the sheets, and the thickness and/or the material of the loaded sheets. Hence, the loading device 200E according to the second embodiment may be able to repeat causing the sheets to form the flexures and flattening (i.e., releasing or relaxing) the flexures of the sheets until the ends of the sheets are in the aligned state. That is, the loading device 200E according to the second embodiment may be able to dispose the sheets in the manual bypass unit 20*m* by accurately aligning the ends of the sheets. Hence, the loading device 200E according to the second embodiment may be able to prevent the sheets from being skewed, jamming, failing to be transferred, being misaligned, or the like when forming images on the sheets inserted in the manual bypass unit 20*m*.

In addition, the loading device 200E according to the second embodiment may be able to obtain effects similar to those obtained by the loading device 100 according to the aforementioned embodiment.

Modification of Second Embodiment

Next, a description is given of a loading device 210E according to a modification of the second embodiment.

Configuration and Functionality of Loading Device

A schematic configuration diagram of the loading device 210E according to a modification of the second embodiment is illustrated in FIG. 1 and the like.

As illustrated in FIG. 1 and the like, a configuration or the like of the loading device 210E according to the modification of the second embodiment is basically similar to that of the loading device 200E according to the second embodiment. Hence, a description of parts of the modification of the loading device 210E according to the second embodiment similar to those of the loading device 200E according to the modification of the second embodiment is omitted from the specification.

Sheet Position Adjusting Operation

A sheet position adjusting operation performed by the recording media loading device 210E according to the modification of the second embodiment is described with reference to FIG. 13, and FIGS. 14A to 14D. Note that the sheet position adjusting operation involves an operation to dispose the sheets by aligning the ends of the sheets.

Figure 13:
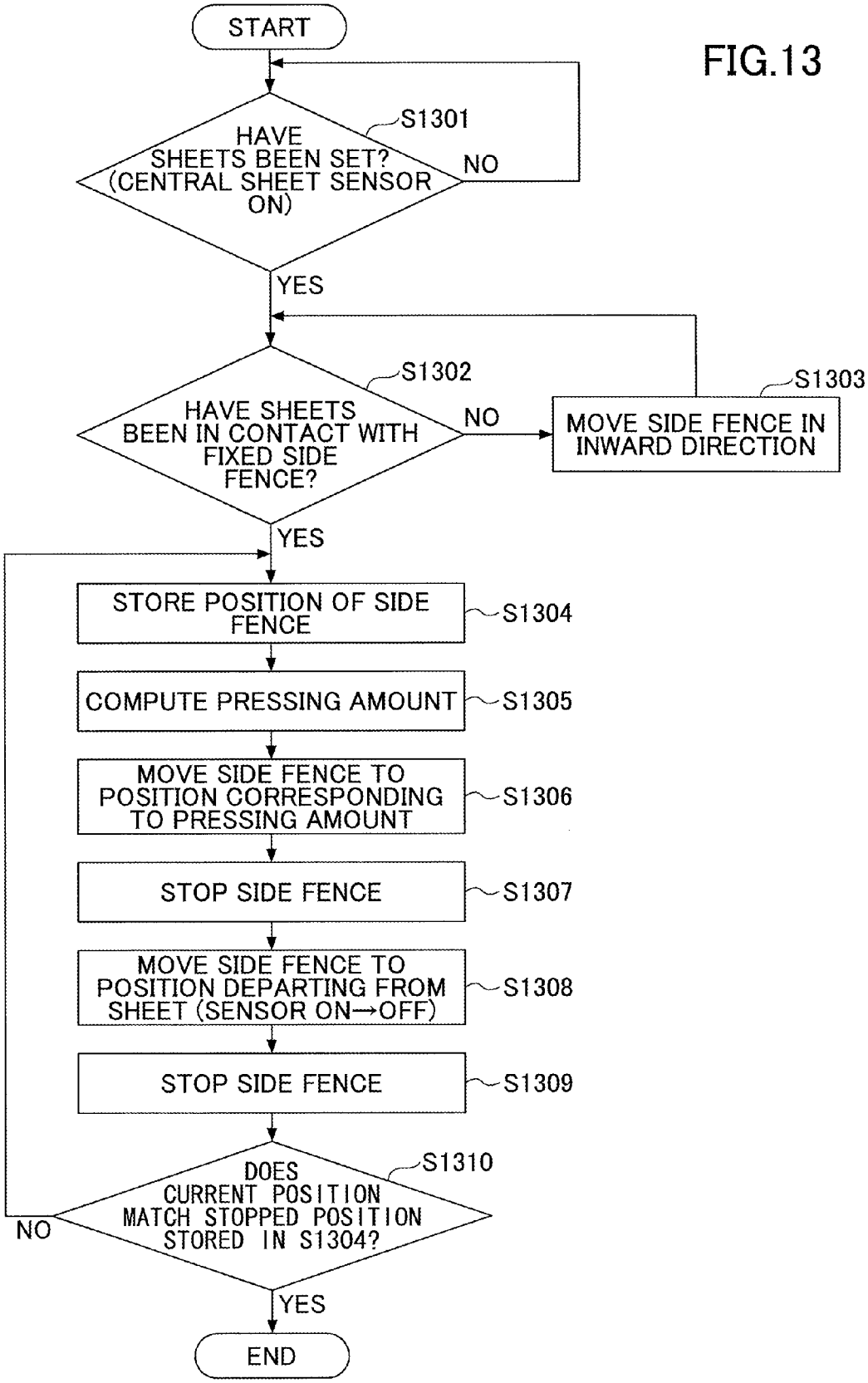
FIG. 13 is a flowchart illustrating an example of operations of a loading device for recording media according to a first modification of the second embodiment.

As illustrated in FIG. 13 and the like, a configuration or the like of the loading device 210E according to the modification of the second embodiment is basically similar to that of the loading device 200E according to the second embodiment. Hence, steps S1301 to S1303 are performed in a manner similar to those performed by the loading device 200E according to the second embodiment.

In step S1304, the loading device 210E stores a position of the side fence 22*bm* (see "Pb" in FIG. 14B) utilizing the storage unit 50 (see FIG. 1). The loading device 210E then proceeds with step S1305.

Figure 14A:
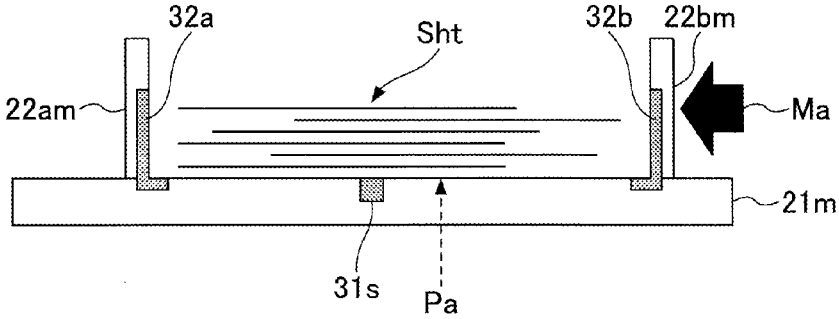
FIGS. 14A to 14D are diagrams illustrating an example of operations of the loading device for recording media according to the first modification of the first embodiment.
Figure 14B:
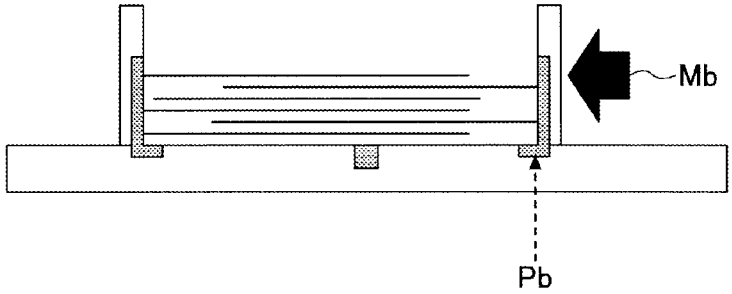
Figure 14C:
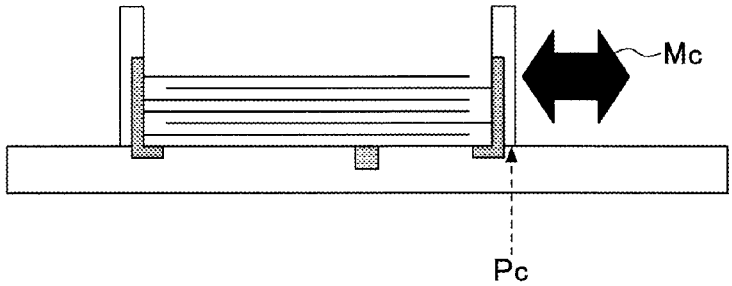
Figure 14D:
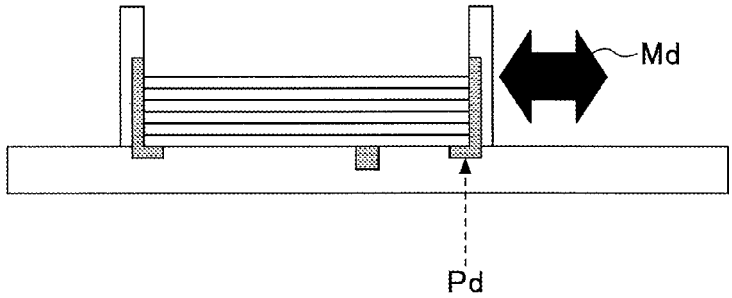

In steps S1305 to S1309, the loading device 210E causes the sheets Sht to form flexures (see "Mc" in FIG. 14C and "Md" in FIG. 14D). Note that operations of the loading device 210E according to the modification of the second embodiment are basically similar to those of the loading device 200E according to the second embodiment. Hence, a description of parts of the modification of the loading device 210E according to the second embodiment similar to those of the loading device 200E according to the second embodiment is omitted from the specification. The loading device 210E then proceeds with step S1310.

In step S1310, the loading device 210E judges whether the ends of the loaded sheets are aligned (in the aligned state) utilizing the judging unit 40 (see FIG. 1). Note that in this modification of the second embodiment, the judging unit 40 compares the position (first position) of the side fence 22*bm* detected by utilizing the end detector 32 (see a sensor 32*b* in FIG. 14D) of the detector 30 and the position (second position) of the side fence 22*bm* stored in step S1304. Further, the judging unit 40 may be able to judge the ends of the sheets as being in the aligned state when the compared result indicates that the first position matches the second position (or the compared result is within a predetermined threshold).

When the loading device 210E judges that the ends of the sheets Sht are in the aligned state, the loading device 210E then ends the sheet position adjusting operation (see "END" in FIG. 13). Otherwise, the loading device 210E proceeds with step S1304.

As described above, the loading device 210E according to the modification of the second embodiment may be able to obtain effects similar to those obtained by the loading device 200E according to the second embodiment.

The loading device according to the disclosed embodiments may be capable of aligning the ends of the loaded recording media by causing the loaded recording media to form the flexures and relaxing the flexures of the recording media.

As described above, the loading device for recording media and the method of controlling the loading device for recording media are described based on the embodiments and modifications. However, the present invention is not limited to these embodiments or modifications. Further, various variations and modifications may be made without departing from the scope of the present invention.

Although the embodiments and modifications are numbered with, for example, "first", "second", or "third", the ordinal numbers do not imply priorities of the embodiments. Many other variations and modifications will be apparent to those skilled in the art.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

The present application is based on and claims the benefit of priority of Japanese Priority Application No. 2012-142412 filed on Jun. 25, 2012, the entire contents of which are hereby incorporated by reference.

What is claimed is:

1. A loading device for loading a plurality of recording media, the loading device comprising:

a disposing unit configured to dispose the recording media; and a detector configured to detect the disposed recording media, wherein the disposing unit includes a loading member on which the recording media are loaded, a pair of guide members mounted on the loading member and configured to be movable in width directions of the recording media, and a guide driver configured to move the guide members, wherein the detector includes a medium detector configured to detect the recording media that have been loaded in an interval between the pair of the guide members, and an end detector configured to detect ends of the loaded recording media, wherein the end detector detects respective positions at which the guide members moved by the guide driver are in contact with the recording media as the ends of the recording media after the medium detector has detected the recording media, and wherein the guide driver further moves, after having moved the guide members in the width direction to cause the guide members to be in contact with the recording media, the guide members in the width direction to cause the recording media to form flexures, subsequently moves the guide members to separate from the recording media, and then moves the guide members to be in contact with the recording media again.

2. The loading device as claimed in claim 1, wherein the guide driver moves one of the pair of the guide members.

3. The loading device as claimed in claim 1, wherein when the guide driver moves the guide members in the width direction to cause the recording media to form the flexure, the guide driver moves the guide members based on at least one of a number of the loaded recording media, moving amounts of the guide members, and a number of times the recording media are caused to form the flexures, determined based on at least one of a thickness and a material of the loaded recording media.

4. The loading device as claimed in claim 1, further comprising:

a judging unit configured to judge a loaded state of the recording media loaded on the loading member, wherein the judging unit judges whether the ends of the loaded recording media are in an aligned state, and wherein the guide driver repeats moving the guide members in the width direction to cause the recording media to form the flexures and to separate from the recording media until the judging unit judges that the ends of the recording media are in the aligned state.

5. The loading device as claimed in claim 4, wherein the judging unit judges the ends of the recording media as being in the aligned state when a difference between a first end position detected by the end detector when the guide members are initially moved and a second end position detected by the end detector when the guide members are subsequently moved is within a predetermined threshold.

6. The loading device as claimed in claim 4, further comprising:

a storage unit configured to store information associated with the recording media, wherein the judging unit judges whether the ends of the loaded recording media are in the aligned state based on the information stored in the storage unit and the detected positions of the ends of the recording media detected by the end detector.

7. A method of controlling a loading device for recording media, the method comprising:

loading the recording media in an interval between a pair of guide members mounted on a loading member;

detecting the recording media loaded on the loading member; and adjusting positions of ends of the recording media loaded on the loading member, wherein the detecting includes moving the guide members in width directions of the recording media, causing the guide members to be in contact with the recording media, and detecting the ends of the recording media based on positions of the guide members that are in contact with the recording media, and wherein the adjusting includes further moving, after having moved the guide members in the width direction to cause the guide members to be in contact with the recording media in the detecting, the guide members in the width direction to cause the recording media to form flexures, subsequently moving the guide members to separate from the recording media, and then moving the guide members to be in contact with the recording media again.

8. A non-transitory computer-readable recording medium storing a program, which, when executed by a processor, causes a computer to perform the control method as claimed in claim 7.

* * * * *